US006020677A

United States Patent [19]

Blanchet-Fincher et al.

[11] Patent Number: 6,020,677

[45] Date of Patent: Feb. 1, 2000

[54] CARBON CONE AND CARBON WHISKER FIELD EMITTERS

[75] Inventors: Graciela Beatriz Blanchet-Fincher; William Leo Holstein; Syed Ismat Ullah Shah, all of Wilmington, Del.

[73] Assignee: E. I. du Pont de Nemours and Company, Wilmington, Del.

[21] Appl. No.: 08/748,451

[22] Filed: Nov. 13, 1996

[51] Int. Cl.[7] ..... H01J 1/30; H01J 19/24

[52] U.S. Cl. ..... 313/336; 313/309; 313/351; 445/50; 445/51

[58] Field of Search ..... 313/309, 310, 313/336, 351, 495, 496, 346 R; 216/11; 445/49, 50, 51, 60

[56] References Cited

U.S. PATENT DOCUMENTS

| | | | |
|---|---|---|---|
| 2,062,370 | 12/1936 | Miller | 250/27.5 |
| 3,866,077 | 2/1975 | Baker et al. | 313/336 |
| 3,883,760 | 5/1975 | Cunningham, Jr. | 313/55 |
| 4,143,292 | 3/1979 | Hosoki et al. | 313/336 |
| 4,728,851 | 3/1988 | Lambe | 313/309 |
| 4,857,799 | 8/1989 | Spindt et al. | 313/495 |
| 4,859,493 | 8/1989 | Lemelson | 427/45.1 |
| 4,925,701 | 5/1990 | Jansen et al. | 427/38 |
| 4,960,643 | 10/1990 | Lemelson | 428/408 |
| 5,010,249 | 4/1991 | Nishikawa | 250/306 |
| 5,015,912 | 5/1991 | Spindt et al. | 313/495 |
| 5,055,744 | 10/1991 | Tsuruoka | 315/169.1 |
| 5,075,094 | 12/1991 | Morrish et al. | 423/446 |
| 5,080,975 | 1/1992 | Komaki et al. | 428/404 |
| 5,082,359 | 1/1992 | Kirkpatrick | 359/642 |
| 5,104,634 | 4/1992 | Calcote | 423/446 |
| 5,129,850 | 7/1992 | Kane et al. | 445/24 |

(List continued on next page.)

FOREIGN PATENT DOCUMENTS

| | | | |
|---|---|---|---|
| 0102139 | 3/1984 | European Pat. Off. . | |
| 0 377 320 | 7/1990 | European Pat. Off. | H05B 33/14 |
| 0 500 119 | 8/1992 | European Pat. Off. | C23C 16/26 |
| 0 588 449 | 3/1994 | European Pat. Off. | H05B 33/14 |
| 0 609 532 | 8/1994 | European Pat. Off. | H01J 1/30 |
| 63-117993 | 5/1988 | Japan | C30B 29/04 |
| 1-111707 | 4/1989 | Japan | C01B 31/06 |
| 4-5964 | 2/1992 | Japan | G02B 6/44 |
| 4-157157 | 5/1992 | Japan | C23C 16/26 |
| 677 238 | 4/1991 | Switzerland | C23C 16/26 |
| WO 94/15350 | 7/1994 | WIPO | H01J 1/62 |
| WO 94/15352 | 7/1994 | WIPO | H01J 19/24 |
| WO 94/28571 | 12/1994 | WIPO | H01J 19/24 |
| WO 95/22169 | 8/1995 | WIPO | H01J 1/30 |
| WO 96/00974 | 1/1996 | WIPO | H01J 9/02 |

OTHER PUBLICATIONS

Asano, T. et al., Field Emission From Ion–Milled Diamond Films on Si, *J. Vac. Sci. Technol. B,* 13(2), pp. 431–434, Mar./Apr. 1995.

Nutzenadel, C. et al., Electron Field Emission From Diamond Tips Prepared by Ion Sputtering, *Appl. Phys. Lett.,* 69 (18), pp. 2662–2664, Oct. 28, 1996.

IBM Technical Disclosure Bulletin, Carbon Whisker Formation, XP–002057989, vol. 20, pp. 775–776, Jul. 1977.

Spindt, C.A. et al, "Physical Properties of Thin Film Field Emission Cathodes",*J. Appl. Phys.,* 47, 5248–5263 (1976) Dec.

Geis, M.W. et al, "Diamond Cold Cathode", *IEEE Electron Device Letters,* 12(8), 456–459 (1991) Aug.

Kumar, N. et al, *SID 93 Digest,* 1009–1011 (1993), Field–Emission Displays Based on Diamond Thin Films (no month).

(List continued on next page.)

*Primary Examiner*—Sandra O'Shea
*Assistant Examiner*—Michael Day

[57] ABSTRACT

Carbon cone and carbon whisker field emitters are disclosed. These field emitters find particular usefulness in field emitter cathodes and display panels utilizing said cathodes. The carbon cone and carbon whisker field emitters can be formed by ion beam bombardment (e.g., ion beam etching) of carbon materials (e.g., bulk carbon, carbon films or carbon fibers).

7 Claims, 18 Drawing Sheets

U.S. PATENT DOCUMENTS

| | | | |
|---|---|---|---|
| 5,138,220 | 8/1992 | Kirkpatrick | 313/309 |
| 5,138,237 | 8/1992 | Kane et al. | 315/349 |
| 5,141,460 | 8/1992 | Jaskie et al. | 445/24 |
| 5,146,481 | 9/1992 | Garg et al. | 378/35 |
| 5,164,051 | 11/1992 | Komaki et al. | 204/129.43 |
| 5,180,951 | 1/1993 | Dworsky et al. | 315/169.3 |
| 5,199,918 | 4/1993 | Kumar | 445/50 |
| 5,229,099 | 7/1993 | Roy | 423/461 |
| 5,256,888 | 10/1993 | Kane | 257/77 |
| 5,258,685 | 11/1993 | Jaskie | 313/309 |
| 5,308,661 | 5/1994 | Feng et al. | 427/535 |
| 5,358,741 | 10/1994 | Gat | 427/249 |
| 5,374,414 | 12/1994 | Morrish et al. | 423/446 |
| 5,560,897 | 10/1996 | Valone et al. | 423/446 |
| 5,578,901 | 11/1996 | Blanchet-Fincher et al. | 313/496 |
| 5,602,439 | 2/1997 | Valone | 313/310 |
| 5,697,827 | 12/1997 | Rabinowitz | 445/60 |

OTHER PUBLICATIONS

Wang, C. et al, *Electronics Letters,* 27(16), 1459–1461 (1991), Cold Field Emission from CVD Diamond Films Observed in Emission Electron Microscope (no month).

Davanloo, F. et al, *Journal Material Res.,* 5(11), 2398–2404 (1990) (Nov.) Laser Plasma Diamond.

Bachman, P.K. et al, *Diamond and Related Materials,* 1, 1–12 (1991) (no month) Towards a General Concept of Diamond CVD.

Angus, J.C. et al, *Proc. 2nd Intern'l Symp. on Diamond Materials,* The Electrochemical Society, Inc., Pennington, NJ, 91–8, 125–141 (1991) (no month).

Johnson, G.H., et al.*Diamond and Diamond–Like Materials Synthesis,* MRS Symposia Proc. EA–15, 99 (1988) (Apr.).

Frenklach, M., *Proc. 2nd Intern'l Symp. on Diamond Materials,* The Electrochemical Society, Inc., Pennington, NJ, 91–8, 142 (1991) (no month) Molecular Process in Diamond Formation.

Maeda, H. et al, *Journal of Crystal Growth,* 121, 507–515 (1992) (no month) Nucleation and Growth of Diamond in a Microwave Plasma.

Givargizov, E.I. et al, *Mat. Letters,* 18(1.2), 61–63 (1993) Nov. Growth of Diamond Particles on Sharpened Silicon Tips.

Stojanovic, et al, *Electronics Ltrs.,* 27(16), 1459–1461 (1991) Aug. Cold Field Emission from CVD Diamond Films.

Dotter et al, "Nucleation & Growth of Highly Transparent Nanocrystalline Diamond Films in Diamond Materials", Dismukes, et al (Eds.), Electrochemical Soc. NJ, Inc., 746–752 (1993) (no month).

Ting et al, *Diamond and Related Materials,* 2, 1069–1077 (1993) (no month) Diamond–Infiltrated Carbon–Carbon Composites.

Roy et al, *Mat. Trd. Bull.,* 28, 861–866 (1993) (no month) Diamond Synthesis via a low Pressure Process.

Bajic, S. et al, *J. Phys. D: Appl. Phys.,* 21, 200–204 (1988) (no month) Enhanced Cold–Cathode Emission using Composite Resin–Carbon Coatings.

*CRC Handbook of Chemistry and Physics,* 7rd edition, CRC Press, 12–10 (1992).

Xu, N.S. et al, *Electronics Letters,* 29(18), 1596–1597 (1993) Sep. Field–Dependence of the Area–Density of CVD Diamond Films.

Litz, M.S. et al, "Rep–rate Explosive Whisker Emission Cathode Investigations", *SPIE Proceedings,* vol. 2154, Jan. 1994, Los Angeles, CA.

Li, Z., "Orientation relationship between chemical vapor deposited diamond and graphite substrates," *J. Appl. Phys.,* 73(2), 711–715 (1993) (Jan.).

Roy, R. et al, "Crystallization of diamond below 1 atm from Carbon–Metal Mixtures", *J. Mater. Chem.,* 3(6), 685–686 (1993) (no month).

Solomons, T.W.G., "Chapter 2: Some Representative Carbon Compounds", *Organic Chemistry,* John Wiley & Sons, NY, 48–49 (1980) (no month).

Dan'ko D.B. et al., Electron and Photon Emission from Discontinuous Carbon Films, *International Journal of* Electronics, 73 N.R. 5, 1005–1008, 1992 (Nov.).

Nistor, L.C. et al., Direct observation of laser–induced crystallization of a– C:H Films, *Applied* Physics, a, No. 58, 137–144 (1994) (no month).

Chernozatonskii, L.A. et al., *Chem. Phys. Letters,* 233, (1995) (Feb.) pp. 63–68 Electron Field Emission from Nanofilament Carbon Films.

Chernozatonskii, L.A. et al., Mat. Res. Soc. Symp. Proc. vol. 359, 99–104 (1995) (no month) Nanotube Carbon Structure Tips.

Viduta, L.V. et al., Electron Emission From Gold and Graphite Films Having a Special Structure in the Presence of a Current Flow and Excitation by an Infrared Laser, *Soviet Journal of Communications Technology* & Electronics, 37 No. 1, 98–104, 1992 (no month).

Lee, C. et al., Comparison of Electron Beams Generated From Laser Activated Tungsten and Graphite Cathodes, *IEEE Conference Record–Abstracts IEEE International Conference on Plasma Science,* 91–92, 1983 (May).

Kumar, N. et al., 6.1: Development of Nano–Crystalline Diamond–Based Field–Emission Displays, *SID International Symposium Digest of Technical* Papers, 25, 43–46, 1994 (Jun.).

Builov, L.L. et al., Effects of Pulsed CO2 Laser Beam on Diamond Films, *Phys. Chem. Mech. Surfaces,* 6(6), 1492–1500, 1991 (Jan.).

van Vechten, J.A., Solberg W., Batson, P.E., Cuomo, J.J. and Rossnagel, S.M., *J. Crystal* Growth, 82, 289, 1987 (no month) "Kink Site Saturation for Whisker Growth under Sputtering Conditions".

Fishbine, B.H., et al., *Mat. Res. Soc. Symp. Proc.,* 359, 1995 (no month) pp. 93–98, Buckytube Cold Field Emitter Array Cathode Experiments.

Dresselhaus, M.S., Dresselhaus, G., Sugihara, K., Spain, I.L. and Goldberg, H.A., *Graphite Fibers and* Filaments, 32–34, 1988 (no month).

Robinson, R.S. et al., *J. Vac. Sci. Technolo,* 21 (3), 1398, 1983 (Oct.) "Ion–Beam Induced Topography and Surface Diffusion".

Floro, J.A., Rossnagel, S.M., and Robinson, R.S., *J. Vac. Sci. Technolo.,* A 1(3), 1398 (Sep.) Ion–Bombardment–Induced Whisker Formation on Graphite.

CARBON CONE AND CARBON WHISKER FIELD EMITTERS

FIELD OF THE INVENTION

This invention generally relates to the use of carbon cone and carbon whisker field emitters and particularly to their use in field emitter cathodes and display panels utilizing such cathodes.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, and klystrons and in lighting.

Display panels are used in a wide variety of applications such as home and commercial televisions, laptop and desktop computers and indoor and outdoor advertising and information presentations. Flat panel displays are only a few inches thick in contrast to the deep cathode ray tube monitors found on most televisions and desktop computers. Flat panel displays are a necessity for laptop computers, but also provide advantages in weight and size for many of the other applications. Currently laptop computer flat panel displays use liquid crystals which can be switched from a transparent state to an opaque one by the application of small electrical signals. It is difficult to reliably produce these displays in sizes larger than that suitable for laptop computers.

Plasma displays have been proposed as an alternative to liquid crystal displays. A plasma display uses tiny pixel cells of electrically charged gases to produce an image and requires relatively large electrical power to operate.

Flat panel displays having a cathode using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth, weight and power consumption advantages of the other flat panel displays. U.S. Pat. Nos. 4,857,799 and 5,015,912 disclose matrix-addressed flat panel displays using micro-tip cathodes constructed of tungsten, molybdenum or silicon. WO 94-15352, WO 94-15350 and WO 94-28571 disclose flat panel displays wherein the cathodes have relatively flat emission surfaces.

Field emission has been observed in two kinds of nanotube carbon structures. L. A. Chernozatonskii et al., Chem. Phys. Letters 233, 63 (1995) and Mat. Res. Soc. Symp. Proc. Vol. 359, 99 (1995) report having produced films of nanotube carbon structures on various substrates by the electron evaporation of graphite in $10^{-5}$–$10^{-6}$ torr. These films consist of aligned tube-like carbon molecules standing next to one another. Two types of tube-like molecules are formed; the A-tubelites whose structure includes single-layer graphite-like tubules forming filaments-bundles 10–30 nm in diameter and the B-tubelites, including mostly multilayer graphite-like tubes 10–30 nm in diameter with conoid or dome-like caps. They report considerable field electron emission from the surface of these structures and attribute it to the high concentration of the field at the nanodimensional tips. B. H. Fishbine et al., Mat. Res. Soc. Symp. Proc. Vol. 359, 93 (1995) discuss experiments and theory directed towards the development of a buckytube (i.e., a carbon nanotube) cold field emitter array cathode.

R. S. Robinson et al., J. Vac. Sci. Technolo. 21 (3), 790 (1982) disclose the formation of cones on the surfaces of substrates under ion bombardment. The effect was reported for various substrate materials the cones and were generated by simultaneously sputtering a surface at high energy while seeding it with impurity atoms deposited at low energy. They also disclosed the formation of carbon whiskers up to 50 $\mu$m in length when a graphite substrate was ion-bombarded with impurities from a stainless steel target.

J. A. Floro, S. M. Rossnagel, and R. S. Robinson, J. Vac. Sci. Technolo. A 1 (3), 1398 (1983) disclose the formation of whiskers during relatively high current density ion bombardment of heated graphite substrates. The whiskers were disclosed to be 2–50 $\mu$m in length and 0.05–0.5 $\mu$m in diameter and to grow parallel to the ion beam. Simultaneous impurity seeding was reported to inhibit whisker growth. J. A. van Vechten, W. Solberg, P. E. Batson, J. J. Cuomo, and S. M. Rossnagel, J. Crystal Growth 82, 289 (1987) discuss the growth of whiskers from graphite surfaces under ion sputtering conditions. They note that the whiskers of smallest diameter, characteristically about 15 nm, definitely appear to be different from either diamond or the scrolled-graphite structure found in carbon fibers grown by catalytic pyrolysis of hydrocarbons. Larger whiskers with diameters ranging from 30 to 100 nm were also observed to grow in sputtering systems. The smaller diameter whiskers are constant in diameter along the length while the larger diameter whiskers may have a slight taper.

M. S. Dresselhaus, G. Dresselhaus, K. Sugihara, I. L. Spain, and H. A. Goldberg, Graphite Fibers and Filaments (Springer-Verlag, Berlin, 1988), pp. 32–34, disclose that filaments may be grown on several types of hexagonal carbon surfaces, but not on diamond or glassy carbon.

In view of this prior art, there is still a need for improved field emission materials for use in field emitter cathodes for display panels and other electronic devices. Other objects and advantages of the present invention will become apparent to those skilled in the art upon reference to the attached drawings and to the detailed description of the invention which hereinafter follows.

SUMMARY OF THE INVENTION

The invention provides for a field emission electron emitter comprised of carbon whiskers, carbon cones or both carbon whiskers and carbon cones. The invention also provides for a field emitter cathode comprised of carbon whiskers, carbon cones or both carbon whiskers and carbon cones attached to a substrate, preferably an electrical conductor. These carbon whiskers and carbon cones can be formed by ion beam bombardment, i.e., ion beam etching, of carbon materials.

Carbon whisker and carbon cone field emitters and field emitter cathodes made therefrom are useful in vacuum electronic devices, flat panel computer and television displays, emission gate amplifiers, klystrons and lighting devices. The panel displays can be planar or curved.

BRIEF DESCRIPTION OF THE FIGURES

FIGS. 1(*a*) and 1(*b*) are at different magnifications.

FIGS. 2(*a*) and 2(*b*) are at different magnifications.

FIGS. 2(*a*) and 2(*b*) (Example 1).

FIGS. 6(*a*) and 6(*b*) are at different magnifications.

FIGS. 8(*a*) and 8(*b*) are at different magnifications.

FIG. 9(*a*) is a linear plot and FIG. 9(*b*) is a logarithmic plot. Both plots show a slight hysteresis between increasing voltage and decreasing voltage.

FIGS. 10(*a*) and 10(*b*) are at different magnifications.

DETAILED DESCRIPTION OF THE PREFERRED EMBODIMENTS

Figure 1A:
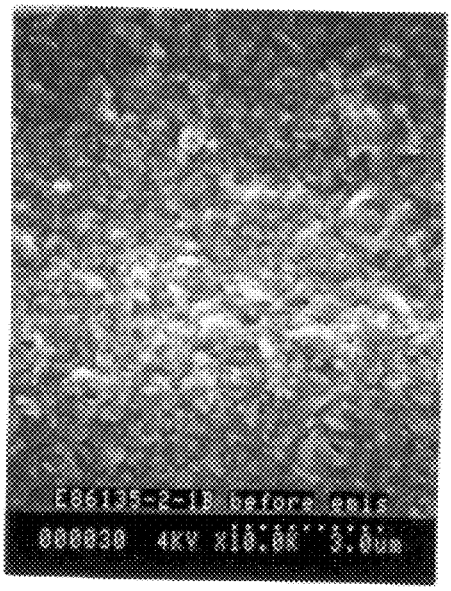
FIGS. 1(*a*) and 1(*b*) are scanning electron micrographs of a carbon film on an alumina substrate.

The carbon whiskers and carbon cones useful as electron emitters in this invention can be formed by ion beam bombardment of carbon materials. The carbon that is ion bombarded to form the carbon whiskers and carbon cones can have a variety of structures and can be prepared in various ways. Bulk carbon, carbon films or carbon fibers can be used. The carbon can be in the form of microcrystalline carbon painted onto a flat substrate or onto a wire. Bulk polycrystalline graphite can also be used. Diamond-like carbon (DLC) deposited on a substrate or a wire using laser ablation and carbon formed on a substrate or wire using a polyacrylonitrile solution are other examples of carbon that can be used.

The carbon whiskers and carbon cones provide good electron emission and field emitter cathodes comprised of these carbon whiskers and carbon cones on a substrate or wire exhibit highly uniform emission. Preferably, the substrate is an electrical conductor such as a metal.

Emission properties of carbon can be significantly improved by ion beam bombardment of the carbon under the following conditions. Beams of argon, neon, krypton or xenon ions can be used. Argon ions are preferred. The pressure during this bombardment is about $0.5\times10^{-4}$ torr ($0.7\times10^{-2}$ Pa) to about $5\times10^{-4}$ torr ($6.7\times10^{-2}$ Pa). The ion beam bombardment is carried out at ion current densities of about 0.1 mA/cm$^2$ to about 1.5 mA/cm$^2$, preferably about 0.5 mA/cm$^2$ to about 1.2 mA/cm$^2$, with beam energies of about 0.5 keV to about 2.5 keV, preferably about 1.0 keV to about 1.4 keV. Bombardment times of about 15 minutes to 90 minutes or more can be used. Ranges of the exposure times and optimal exposure times depend on the type of carbon being bombarded as well as on the other bombardment conditions. Under these conditions, carbon whiskers and carbon cones can be formed on the carbon surface. Any ion source can be used. Currently, Kaufmann Ion Sources are the most readily available commercially.

Any metal or refractory material can be used as a cathode substrate. Copper and tungsten are preferred metals for this use. Silicon, alumina, MgO and $ZrO_2$ are examples of suitable refractory materials. The substrate can have any shape that is convenient; for example, it can be planar or curved or it can be in the form of a wire.

Certain additives to the carbon result in increased emission from the carbon both before and after ion bombardment. These additives can be introduced in various ways. Such additives can readily be introduced during the ablation deposition of DLC by having the additive present in the target that is being ablated. Typical additives are Pb, Mo, Se and B. The ablation target used is comprised of about 3 wt % to about 20 wt % additive, about 70 wt % to about 87 wt % carbon and about 5 wt % to about 30 wt % polymer. A typical polymer that can be used is polyethylene. Improvement in emission properties has also been observed when the ablation target is comprised of carbon and polyethylene, i.e., the ablation target used is comprised of about 70 wt % to about 95 wt % carbon and about 5 wt % to about 30 wt % polymer.

The surface structure of the carbon changes significantly during ion bombardment. As a result of etching, it is no longer smooth, but instead becomes textured and is comprised of cones of carbon. The density or spacing of these cones and their sizes depend on the nature of the the carbon being bombarded. The heights of the cones are typically about 0.3 $\mu$m to about 0.8 $\mu$m for bulk carbon, but for a carbon film the heights are no greater than the original thickness of the carbon film. Diameters of the cones range from about 0.1 $\mu$m to about 0.5 $\mu$m. The carbon cones develop in the direction toward the incident ion beam so that when ion beam etching is carried out at angles other than 90° (e.g., normal to the surface), the cones are not normal to the surface. The results of ion beam etching of bulk polycrystalline graphite are similar to that of microcrystalline graphite thin films. In both instances, the graphite etches uniformly over a 1 square inch area, i.e., the density of the cones (the number of cones per unit area) and the appearance of the cones is uniform. Carbon fibers and carbon films on non-carbon fibers (e.g., a metal wire) etch in a manner somewhat different from the manner in which carbon films on flat substrates or bulk carbon samples etch. When the ion beam is normal to the axis of the fiber, cones form predominantly along the sides of the fiber. Cones are not usually present along the center of the fiber, i.e., that part of the fiber which is closest to the ion beam source, and they are also not present along the back of the fiber which is not exposed directly to the ion beam. Cones can be formed more uniformly around the fiber by rotating the fiber during ion beam bombardment. For carbon films deposited on non-carbon fibers, the density of carbon cones after ion beam bombardment is lower than the density of carbon cones on both carbon fibers and carbon films on flat surfaces after similar ion beam bombardment.

Transmission electron micrographs of the cones formed on a carbon film indicate that they consist of small grains of crystalline carbon. A cone is believed to be that part of the original microcrystalline carbon film which is left behind following ion beam etching.

In addition to carbon cones, carbon whiskers are also formed during ion bombardment of carbon surfaces. Ion beam bombardment can result in the formation of cones, cones and whiskers or, when DLC is bombarded, just whiskers. When additives such as Pb are present in the DLC, structures resembling cones are also formed. When cones are present, carbon whiskers are typically located at the tips of the cones. The lengths of the carbon whiskers can extend from 2 $\mu$m to distances of 20 $\mu$m or more. In the case of a carbon film, the lengths of the carbon whiskers can be much greater than the initial thickness of the carbon film. Diameters of the whiskers are in the range of 0.5 to 50 nm.

The carbon whiskers form in the direction toward the incident ion beam. The carbon whiskers are flexible, and they have been observed to move during scanning electron microscopy measurements. On carbon fibers and carbon films on non-carbon fibers, the carbon whiskers grow in the same regions as do the carbon cones, i.e., when the ion beam is normal to the axis of the fiber, whiskers form predominantly along the sides of the fiber. Whiskers are not usually present along the center of the fiber, i.e., that part of the fiber which is closest to the ion beam source, and they are also not present along the back of the fiber which is not exposed directly to the ion beam.

For the non-limiting Examples that follow, a 3 cm-diameter ion gun (Kauffman Ion Source, Model II) was used to create an argon ion beam of about 2 inches diameter (5 cm) at the sample surface. This involved a turbo-pumped system with a base pressure of $1\times10^{-8}$ torr ($1.3\times10^{-6}$ Pa). After the base pressure was reached, the working gas, argon, was fed into the system through a needle valve until a steady working pressure of $1\times10^{-4}$ torr ($1.3\times10^{-2}$ Pa) was achieved. The distance between the ion gun and the surface was 4–5 inches (10–12.5 cm).

Transmission electron micrographs of the carbon whiskers indicate that they are solid and consist of amorphous carbon. This material is believed to be carbon which has been removed from the original film by ion beam etching and then redeposited, initially typically at the tips of cones and then at the tips of the growing whiskers. Alternately, the whiskers may form by carbon activated by the ion beam which diffuses to the tips of the cones or whiskers. Carbon whiskers differ in structure from carbon nanotubes. Carbon nanotubes are hollow and contain shells of graphite-like sheets of carbon. Carbon whiskers are solid and exhibit no long range crystalline order in any direction.

Field emission tests were carried out on carbon samples on a flat substrate or on bulk carbon samples using a flat-plate emission measurement unit comprised of two electrodes, one serving as the anode or collector and the other serving as the cathode. This will be referred to in the Examples as Measurement Unit I. The unit was comprised of two square copper plates, 1.5 in by 1.5 in (3.8 cm×3.8 cm), with all corners and edges rounded to minimize electrical arcing. Each copper plate was embedded in a separate polytetrafluoroethylene (PTFE) block, 2.5 in ×2.5 in (4.3 cm×4.3 cm), with one 1.5 in by 1.5 in (3.8 cm×3.8 cm) copper plate surface exposed on the front side of the PTFE block. Electrical contact to the copper plate was made by a metal screw through the back of the PTFE block and extending into the copper plate, thereby providing a means to apply an electrical voltage to the plate and means to hold the copper plate firmly in place. The two PTFE blocks were positioned with the two exposed copper plate surfaces facing one another and in register with the distance between the plates fixed by means of glass spacers placed between the PTFE blocks but distanced from the copper plates to avoid surface leakage currents or arcing. The separation distance between the electrodes can be adjusted, but once chosen, it was fixed for a given set of measurements on a sample. Typically, separations of 0.1 cm to about 0.2 cm were used.

The substrate or the bulk carbon sample was placed on the copper plate serving as the cathode. In the case of a conducting substrate, the sample was held in place and electrical contact was made by applying a small drop of carbon paint to the back of the sample and allowing it to dry. In the case of an insulating substrate with a conducting film, the substrate was held down on two sides with conducting copper tape, which also served to provide for electrical contact.

The test apparatus was inserted into a vacuum system, and the system was evacuated to a base pressure below $1\times10^{-6}$ torr ($1.3\times10^{-4}$ Pa). A negative voltage was applied to the cathode and the emission current was measured as a function of the applied voltage. Since the separation distance between the plates d and the voltage V were measured, the electric field E could be calculated (E=V/d) and the current could be plotted as a function of the electric field. Typically, measurements were recorded at 25 V increments. At each voltage, 10 individual measurements of emission current were made and the results were averaged. Typically, the sample was cycled 10 times from the lowest to the highest emission currents. On some occasions, following 10 such cycles, an additional set of measurements was recorded at constant voltage for an extended period of time to examine the lifetime of the emitter.

Another emission measurement unit was used for carbon fibers and for samples in which carbon films had been formed on wires or fibers. This will be referred to in the Examples as Measurement Unit II. Electron emission from wires or fibers was measured in a cylindrical test fixture. In this fixture, the conducting wire to be tested served as the cathode and was mounted in the center of a cylinder which served as the anode. This anode cylinder typically consisted of a fine mesh cylindrical metal screen coated with a phosphor. Both the cathode and anode were held in place by an aluminum block with a semi-cylindrical hole cut therein.

The conducting wire or fiber was held in place by two 1/16 inch-diameter stainless steel tubes, one at each end. These tubes were cut open at each end, forming an open trough in the shape of a half cylinder of length ½ inch and diameter 1/16 inch, and the wire or fiber was placed in the open trough that results and held in place with silver paste. The connecting tubes were held in place within the aluminum block by tight fitting polytetrafluoroethylene (PTFE) spacers, which served to electrically separate the anode and cathode. The total length of exposed wire or fiber was generally set at 1.0 cm, although shorter or longer lengths could be studied by controlling the placement of the holder tubes. The cylindrical screen mesh cathode was placed in the semi-cylindrical trough in the aluminum block and held in place with copper tape. The cathode was in electrical contact with the aluminum block.

Electrical leads were connected to both the anode and cathode. The anode was maintained at ground potential (0 V) and the voltage of the cathode was controlled with a 0–10 kV power supply. Electrical current emitted by the cathode was collected at the anode and measured with an electrometer. The electrometer was protected from damaging current spikes by an in-series 1 MΩ resistor and in-parallel diodes which allowed high current spikes to bypass the electrometer to ground.

Samples for measurement of length about 2 cm were cut from longer lengths of wire or fiber samples. With the flexible stainless steel screen with phosphor removed, they were inserted into the cylindrical troughs of the two holder arms. Silver paste was applied to hold them in paste. The silver paste was allowed to dry and the phosphor screen was reattached and held in place with copper tape at the two ends. The test apparatus was inserted into a vacuum system, and the system was evacuated to a base pressure below $1\times10^{-6}$ torr ($1.3\times10^{-4}$ Pa).

Emission current was measured as a function of applied voltage. Electrons emitted from the cathode created light when they stroke the phosphor on the anode. The distribution and intensity of electron emission sites on the coated wire were observed by the pattern of light created on the phosphor/wire mesh screen. The average electric field E at the wire surface was calculated through the relationship E=V/[a 1 n (b/a)], where V was the voltage difference between the anode and cathode, a was the wire radius, and b was the radius of the cylindrical wire mesh screen. Typically, measurements were recorded at 25 V increments. At each voltage, 10 individual measurements of emission current were made and the results were averaged. Typically, the sample was cycled 10 times from the lowest to the highest emission currents (usually 1 nA to 100–500 μA). On occasions, following 10 such cycles, an additional set of measurements was recorded at constant voltage for an extended period of time to examine the lifetime of the emitter.

EXAMPLES

The following non-limiting examples are intended to further enable and describe the present invention.

Example 1 and Comparison Experiment A

Microcrystalline carbon films were deposited onto two one-inch square (2.5 cm×2.5 cm) polycrystalline alumina substrates that were 0.65 mm thick by painting each substrate with a suspension of microcrystalline carbon (colloidal graphite, Neolube No. 2, Huron Industries, Fort Huron, Mich.) dispersed in isopropanol. The suspension was allowed to dry in air, forming a microcrystalline carbon film of thickness greater than 1 μm on each substrate.

One of the two essentially identical carbon films was not bombarded with an ion beam and was set aside to be used in Comparison Experiment A.

The second carbon film was used in Example 1 and was subjected to argon ion beam bombardment under the following conditions: ion beam makes a 45° angle of incidence with the film sample, beam current of 18 mA, beam voltage of 1.2 kV, ion beam gun-sample distance of 5 inches (12.5 cm), beam diameter at sample of 2 inches (5 cm), argon partial pressure of $1\times10^{-4}$ torr ($1.3\times10^{-2}$ Pa), and exposure time of 20 minutes.

Figure 1B:
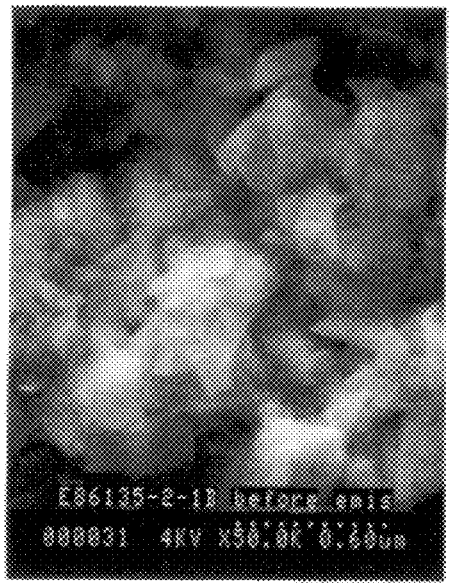
Figure 2A:
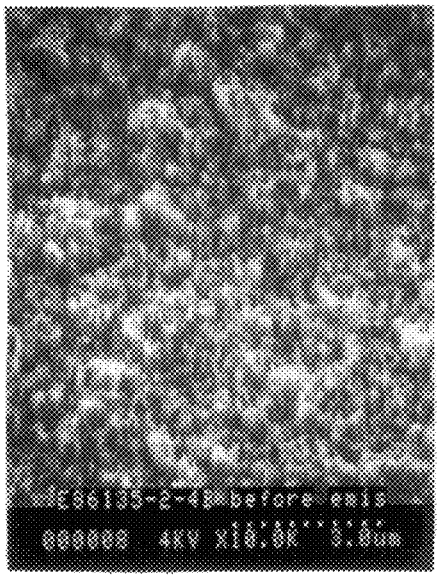
FIGS. 2(*a*) and 2(*b*) are scanning electron micrograph images of carbon cones and carbon whiskers formed on an ion beam bombarded carbon film on an alumina substrate.
Figure 2B:
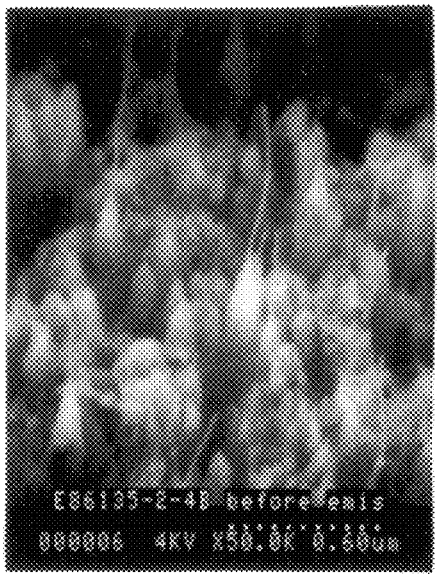
Figure 3:
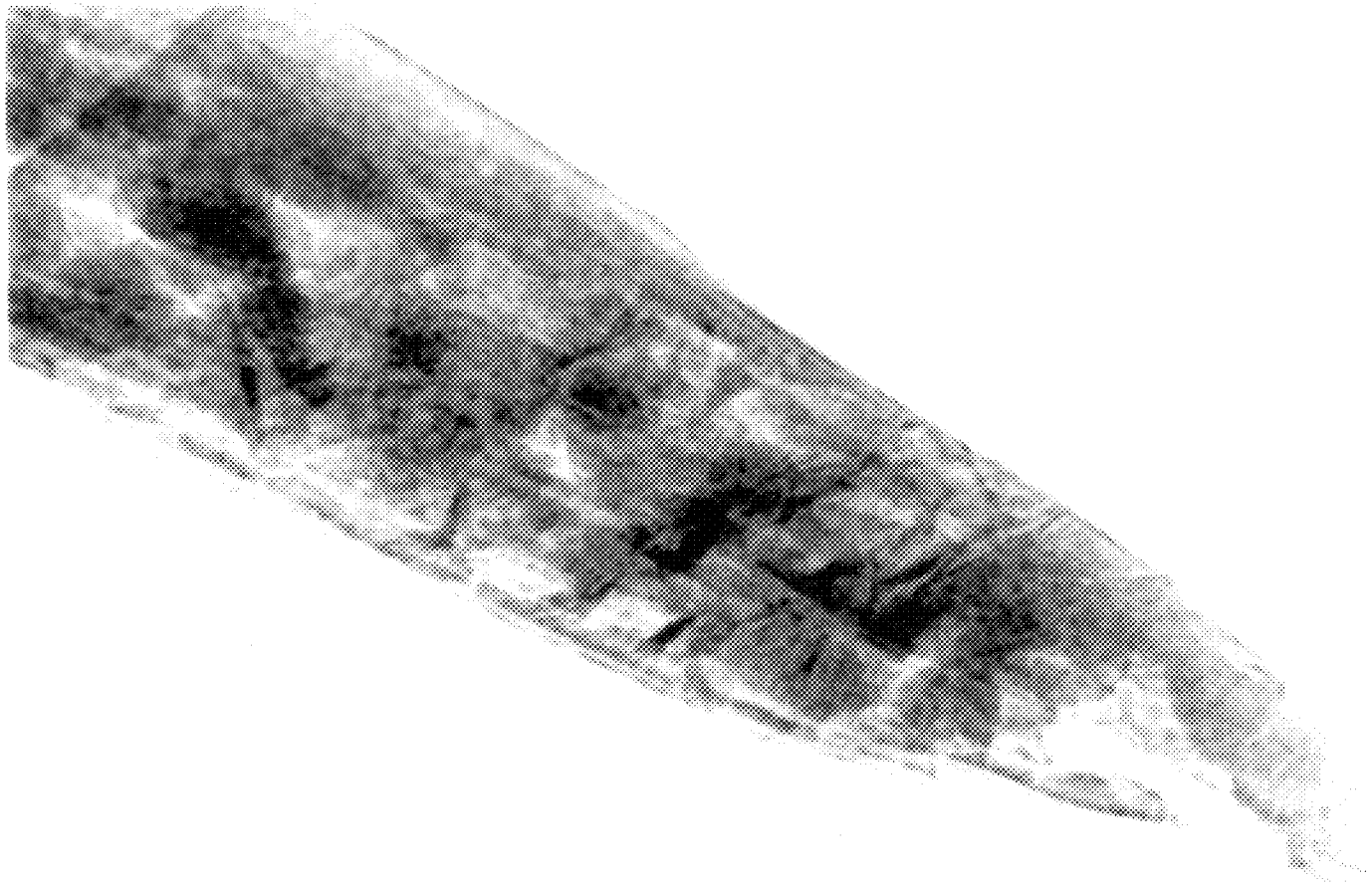
FIG. 3 is a transmission electron micrograph of a carbon cone formed by ion bombardment of a carbon film on an alumina substrate.
Figure 4:
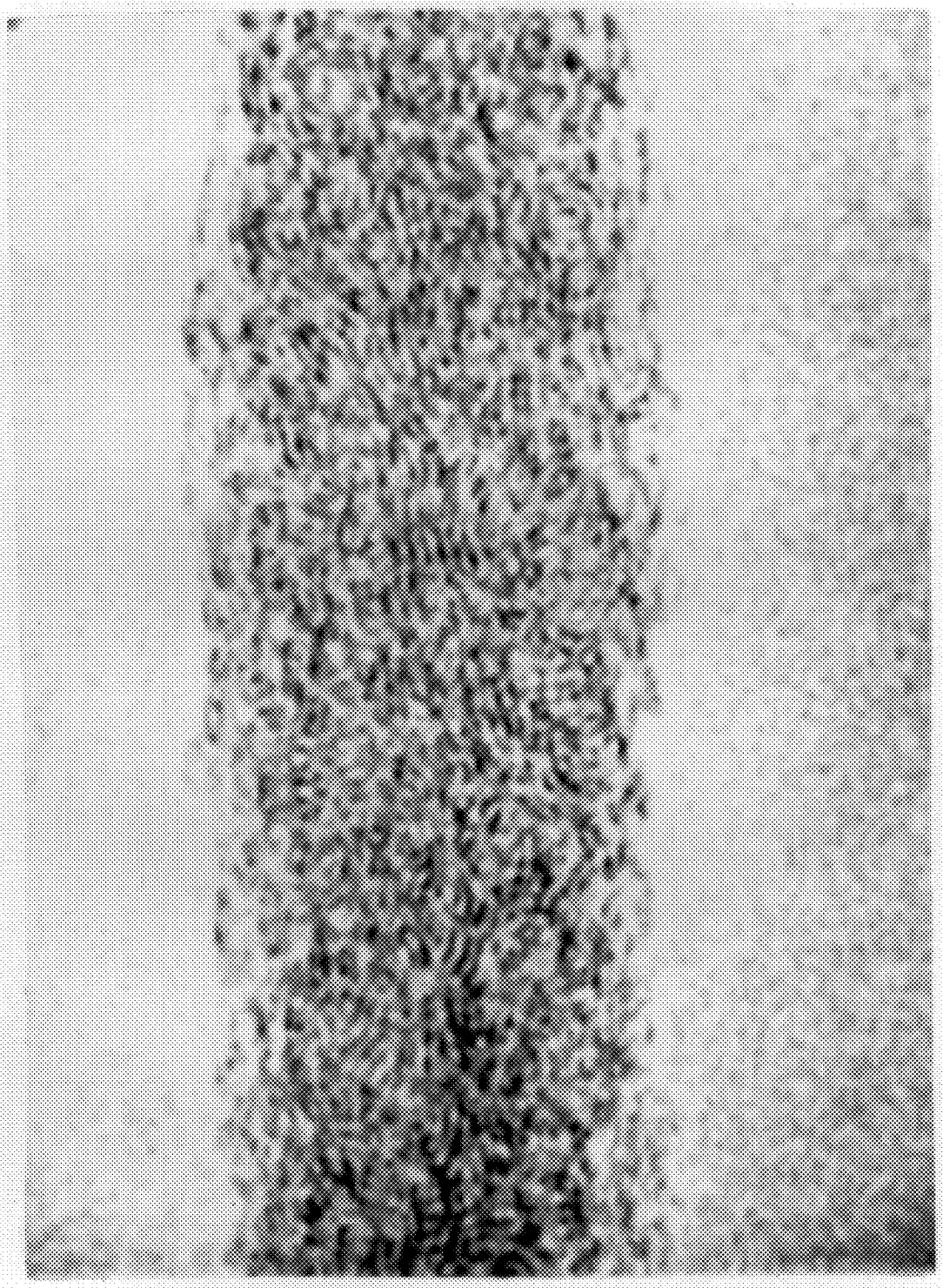
FIG. 4 is a transmission electron micrograph of a carbon whisker formed by ion bombardment of a carbon film on an alumina substrate.

Scanning electron micrographs of the carbon film of Comparison Experiment A having undergone no ion beam bombardment and the carbon film of Example 1 which did undergo ion beam bombardment are shown in FIGS. 1(*a*)/1(*b*) and FIGS. 2(*a*)/2(*b*), respectively. The surface of the carbon film of Comparison Experiment A contains only a small amount of roughness on a length scale of around 1 μm. There are no sharp features and there are no carbon whiskers. The surface of the carbon film of Example 1 is comprised of sharp carbon cones with carbon whiskers located at the tips of most of the carbon cones. The carbon cones and carbon whiskers pointed in a direction 45° to the substrate normal, i.e., in the direction of the incident ion beam. FIG. 3 shows a transmission electron micrograph of one of the carbon cones. It consists of small grains of crystalline carbon. FIG. 4 shows a transmission electron micrograph of one of the carbon whiskers. It is solid and consists of amorphous carbon.

The alumina substrate with the carbon film of Comparison Experiment A was placed on the copper block cathode of Measurement Unit I and two pieces of conducting carbon tape were applied at each side of the substrate both to hold the substrate in place and to provide electrical contact to the conducting carbon film. The total remaining exposed area of carbon was about 5 $cm^2$. The separation distance of the surface of the carbon film and the copper block anode was 1.3 mm. No significant emission, i.e., emission current less than 1 nA, was observed at voltages up to 4000 V.

Figure 5:
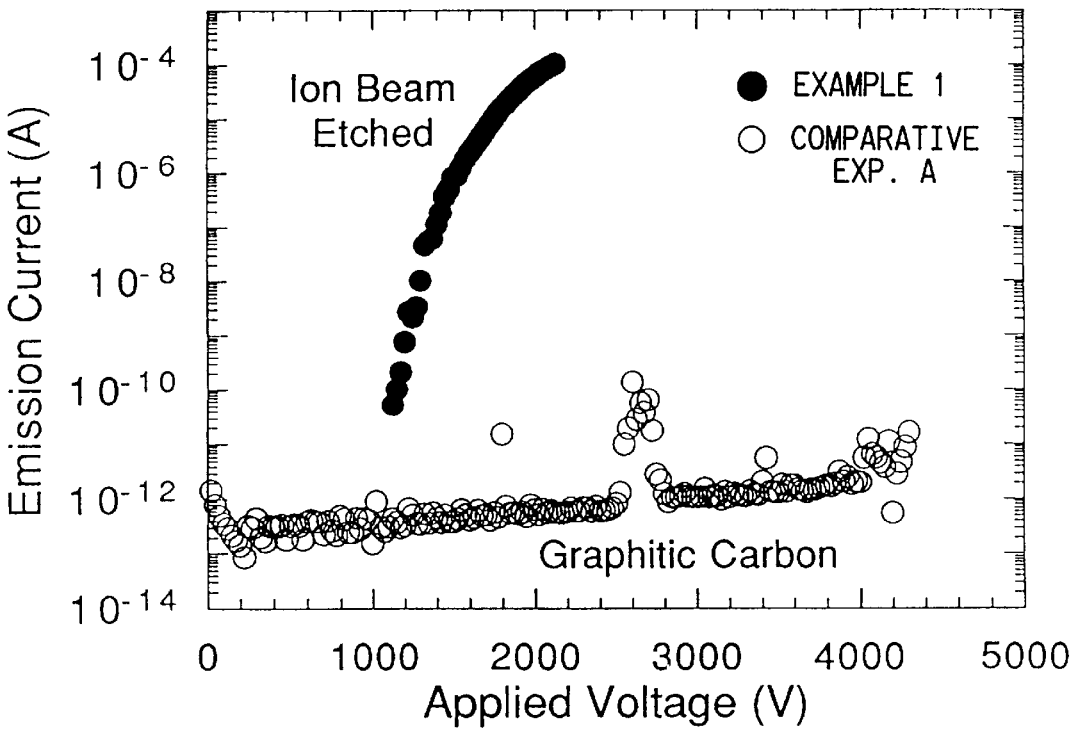
FIG. 5 is a plot of emission current as a function of applied voltage for the carbon films shown in FIGS. 1(*a*) and 1(*b*) (Comparative Experiment A) vs.

The alumina substrate with the carbon film of Example 1 was placed on the copper block cathode of Measurement Unit I and two pieces of conducting carbon tape were applied at each side of the substrate both to hold the substrate in place and to provide electrical contact to the conducting carbon film. The total remaining exposed area of carbon was about 5 $cm^2$. The separation distance of the surface of the carbon film and the copper block anode was 1.3 mm. The emission current was measured as a function of voltage. The voltage was increased in 25 V increments until the emission current exceeded 100 μA. This occurred at a voltage of about 2200 V. The voltage was cycled up and down between settings yielding a minimum emission current of 10 pA and a maximum emission current of 100 μA. During the second cycle of the voltage, the emission current was 10 μA at 1450 V (current density of 2.0 $\mu A/cm^2$ at an applied electric field of $1.35\times10^4$ V/cm) and 100 μA at 2150 V (current density of 20 $\mu A/cm^2$ at an applied electric field of $1.65\times10^4$ V/cm). Similar values of emission current were obtained for the third through tenth cycles of the voltage. The emission results for Example 1 and Comparison Experiment A are plotted in FIG. 5.

This Example shows that the carbon cones and carbon whiskers can point at an acute angle to the film surface and provide good electron emission.

Example 2

A microcrystalline carbon film of thickness greater than 1 μm was prepared on an alumina substrate essentially as described in Example 1. The carbon film was subjected to argon ion beam bombardment under the following conditions: ion beam makes a 90° angle of incidence with the film sample, i.e., is normal to the film sample, beam current of 15 mA, beam voltage of 1.2 kV, ion beam gun-sample distance of 4 inches (10 cm), beam diameter at sample of 2 inches (5 cm), argon partial pressure of $1\times10^{-4}$ torr ($1.3\times10^{-2}$ Pa), and exposure time of 45 minutes. Following ion beam bombardment, scanning electron micrography showed that the film surface was comprised of carbon cones normal to the surface with carbon whiskers at the tips of the carbon cones also normal to the surface, i.e., in the direction of the incident ion beam. Emission measurements were carried out essentially as described in Example 1. Emission from this sample (10 μA at 1500 V) was comparable to emission from Example 1, in which the carbon cones and carbon whiskers pointed in a direction 45° to the substrate normal.

This Example shows that the carbon cones and carbon whiskers can point normal to the film surface and provide good electron emission. Good electron emission is not dependent on the orientation of the cones and whiskers with respect to the film surface.

Example 3

A carbon microcrystalline film of thickness greater than 1 μm was prepared essentially as described in Example 1 except that the substrate was a one-inch square (2.5 cm×2.5 cm) of copper sheet. The carbon film was subjected to argon ion beam bombardment under the following conditions: ion beam makes a 45° angle of incidence with the film sample, beam current of 20 mA, beam voltage of 1.2 kV, ion beam gun-sample distance of 5 inches (12.5 cm), beam diameter at sample of 2 inches (5 cm), argon partial pressure of $1\times10^{-4}$ torr ($1.3\times10^{-2}$ Pa) and exposure time of 60 minutes. Following the ion beam bombardment, scanning electron micrography showed that the film surface was comprised of carbon cones with carbon whiskers at the tips of the carbon cones. The carbon cones and carbon whiskers pointed in a direction 45° to the substrate normal, i.e., in the direction of the incident ion beam. Emission measurements were carried out essentially as described in Example 1. Emission current from this sample was 10 μA at 2375 V.

This Example shows that good emission occurs from an ion beam bombarded carbon film on an metallic substrate.

Examples 4 and 5 and Comparison Experiment B

A microcrystalline carbon film of thickness greater than 1 μm was prepared on each of three alumina substrates essentially as described in Example 1. Except for exposure times, the three films were subjected to essentially the same argon ion beam bombardment under the following conditions: ion beam makes a 45° angle of incidence with the film sample, beam current of 17 mA, beam voltage of 1.2 kV, ion beam gun-sample distance of 4 inches (10 cm), beam diameter at sample of 2 inches (5 cm) and argon partial pressure of $1\times10^{-4}$ torr ($1.3\times10^{-2}$ Pa).

The exposure times for the carbon films of Comparison Experiment B and Examples 4 and 5 were 15 minutes, 45 minutes and 90 minutes, respectively. Emission measurements were carried out essentially as described in Example 1. Emission current from the carbon film of Comparison Experiment B was 5 μA at 3375 V. Typically, the voltage required to result in a 10 μA current was used for comparison with other samples. However, for the carbon film of Comparison Experiment B the highest voltage applied yielded only 5 μA. Higher voltages would result in arcing in the apparatus. Emission from the carbon film of Example 4 was 10 μA at 1600 V and that for the carbon film of Example 5 was 10 μA at 625 V. The emission characteristic of Example 4 was considerably better than that of Comparison Experiment B and the emission characteristic of Example 5 was considerably better than that of Example 4.

These Examples and Comparison Experiment B show that longer exposure times to the ion beam bombardment result in carbon films with higher emission. However, the exposure time cannot be arbitrarily long; if exposure is continued the ions will continue to etch the carbon film and finally etch off the entire carbon film.

Examples 6–9

A microcrystalline carbon film of thickness greater than 1 μm was prepared on each of four alumina substrates essentially as described in Example 1. Except for beam voltages, the four films were subjected to essentially the same argon ion beam bombardment under the following conditions: ion beam makes a 45° angle of incidence with the film sample, beam current of 17 mA, ion beam gun-sample distance of 4 inches (10 cm), beam diameter at sample of 2 inches (5 cm), argon partial pressure of $1\times10^{-4}$ torr ($1.3\times10^{-2}$ Pa) and exposure time of 60 minutes.

The beam voltages used for the carbon films of Examples 6–9 were 500 V, 700 V, 1.2 keV and 1.5 keV, respectively. Emission measurements were carried out essentially as described in Example 1. Emission currents from the carbon films of Example 6–9 were 10 μA at 2350 V for Example 6, 10 μA at 1775 V for Example 7, 10 μA at 450 V for Example 8 and 10 μA at 950 V for Example 9.

These Examples show that there is an optimal beam voltage of about 1200 V for these films when the exposure time is 60 minutes. Beam voltages lower than the optimal, i.e., lower energy ions, result in less topographical modification of the carbon film and less emission current. Beam voltages higher than the optimal, i.e., higher energy ions, result in degradation of the emission properties. This may be due to excessive etching of the carbon film and a decrease in the number of cones and whiskers.

Example 10

A solid block of 99.95% pure polycrystalline graphite (Goodfellow Corp., Berwyn, Pa.) 1 inch (2.5 cm) square and 0.51 mm thick was subjected to argon ion beam bombardment under the following conditions: ion beam makes a 45° angle of incidence with the film sample, beam current of 20 mA, beam voltage of 1.2 kV, ion beam gun-sample distance of 5 inches (12.5 cm), beam diameter at sample of 2 inches (5 cm), argon partial pressure of $1\times10^{-4}$ *torr* ($1.3\times10^{-2}$ Pa), and exposure time of 45 minutes. Emission measurements were carried out essentially as described in Example 1, except that the gap spacing was 1.4 mm. Emission from this sample was measured to be 10 μA at 2325 V.

This Example shows that good emission occurs from ion beam bombarded bulk carbon.

Example 11

A solid block of polycrystalline graphite essentially identical to that used in Example 10was subjected to argon ion beam bombardment under the following conditions while on a heater at a temperature of 400° C.: ion beam makes a 45° angle of incidence with the film sample, beam current of 18 mA, beam voltage of 1.2 kV, ion beam gun-sample distance of 5 inches (12.5 cm), beam diameter at sample of 2 inches (5 cm), argon partial pressure of $1\times10^{-4}$ torr ($1.3\times10^{-2}$ Pa), and exposure time of 90 minutes. Emission measurements were carried out essentially as described in Example 1, except that the gap spacing was 1.4 mm. Emission from the sample was measured to be 10 $\mu$A at 1475 V.

This Example shows that good emission occurs from ion beam bombarded bulk carbon that is heated during the ion beam bombardment.

Example 12

A tungsten wire 125 $\mu$m in diameter was dipped into a solution of colloidal carbon in isopropanol (Neolube No. 2; Huron Industries, Fort Huron, Mich.) and allowed to dry, resulting in the formation of a layer of carbon on the wire. This process was repeated several times to increase the thickness of the carbon film on the tungsten wire. The wire was then subjected to argon ion beam bombardment under the folowing conditions: ion beam essentially normal to the axis of the wire, beam current of 20 mA, beam voltage of 1.2 kV, ion beam gun-sample distance of 4 inches (10 cm), beam diameter at sample of 2 inches (5 cm), argon partial pressure of $10^{-4}$ torr ($1.3\times10^{-2}$ Pa), and exposure time of 120 minutes.

The tungsten wire with the carbon film was mounted in Measurement Unit II and the length of exposed carbon film was 1 cm. The emission current was measured as a function of voltage and was 10 $\mu$A at 2240 V. The emission formed a light pattern on the phosphor-coated anode screen. The pattern extended along the length of the wire. The pattern did not extend 360° around the wire but subtended an angle of 90°–120° and the remaining 240°–270° portion was not illuminated.

This Example shows that graphitic carbon can be coated onto metal wires and that these coated wires can be made to emit with useful properties by ion beam etching. The direction of electron emission can be controlled by ion beam etching the wire from only one side. Such "directional" wire-based electron emitters may provide for enhanced performance as cathodes in certain applications.

Example 13 and Comparison Experiment C

Carbon fibers (AS4, Hercules Inc., Wilminton, Del.) each of 7 $\mu$m diameter were spread in a holder in an array of 2–3 layers of fibers and were subjected to argon ion beam bombardment under the following conditions: ion beam essentially normal to the axis of the fibers, beam current of 20 mA, beam voltage of 1.2 kV, ion beam gun-sample distance of 4 inches (10 cm), beam diameter at sample of 2 inches (5 cm), argon partial pressure of $1\times10^{-4}$ torr ($1.3\times10^{-2}$ Pa), and exposure time of 30 minutes.

Figure 6A:
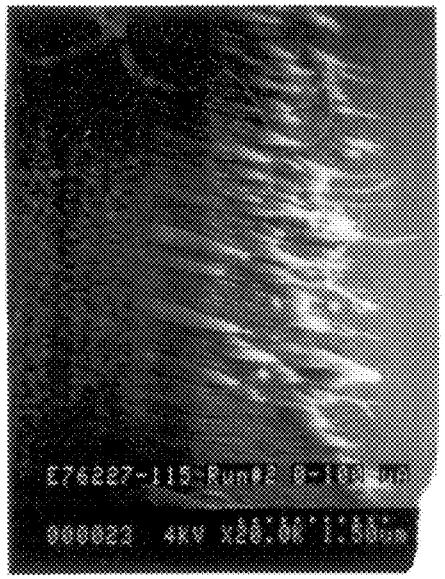
FIGS. 6(*a*) and 6(*b*) are scanning electron micrographs of carbon whiskers formed by ion bombardment of a carbon fiber.
Figure 6B:
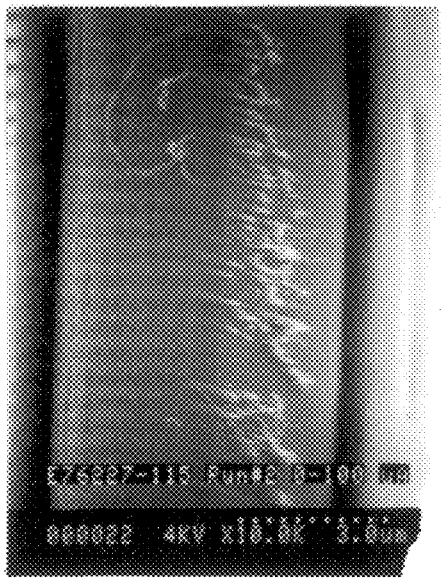

The fibers were stationary and only one side of the fibers was exposed to the ion beam. Following the ion beam bombardment, scanning electron micrography showed that the film surface contained features similar to the polycrystalline carbon film and the solid carbon block and was comprised of carbon cones with carbon whiskers at the tips of the carbon cones, as can be seen in the scanning electron micrographs shown in FIGS. 6(*a*) and 6(*b*). The carbon cones and carbon whiskers pointed in the direction of the incident ion beam.

Figure 7:
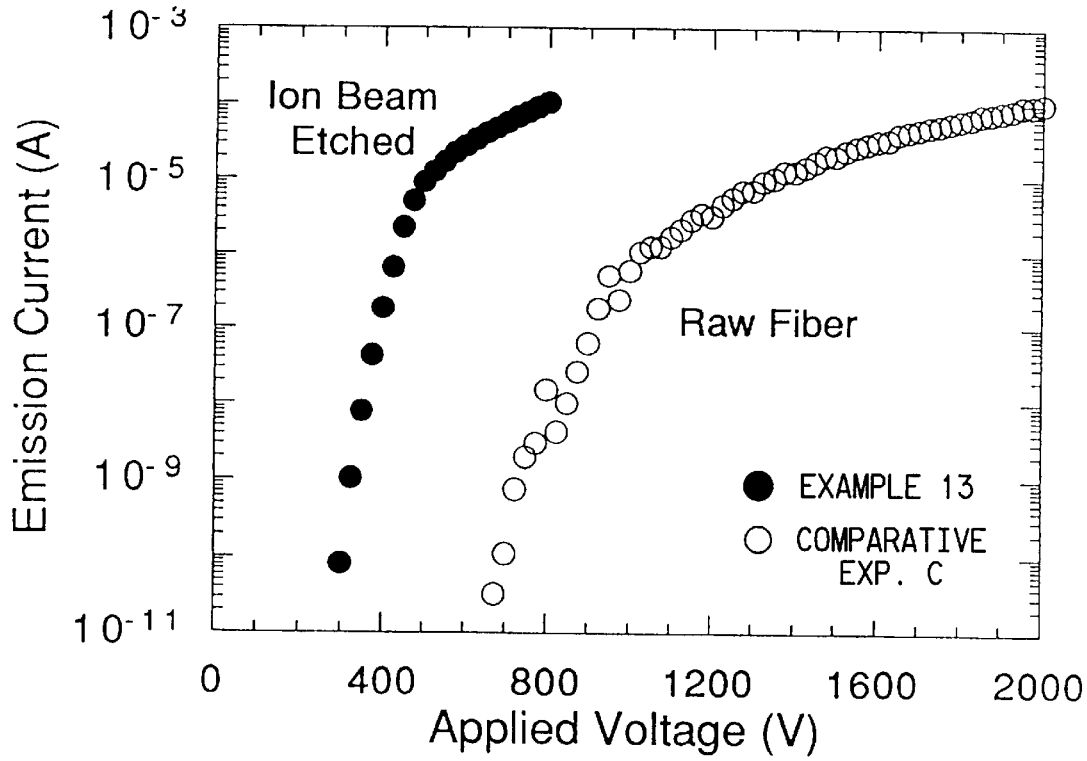
FIG. 7 is a plot of emission current as a function of applied voltage for a 7 $\mu$m diameter PAN carbon fiber before ion beam bombardment (Comparative Experiment C) and following ion beam bombardment Example 13).

A single carbon fiber about 2 cm long was then mounted in Measurement Unit II and the length of exposed carbon fiber was 1 cm. Electron emission was measured and the results are shown in FIG. 7.

For Comparison Experiment C, a 7 $\mu$m diameter carbon fiber essentially identical to those bombarded with the ion beam in Example 13 was mounted in Measurement Unit II without having been subjected to ion beam bombardment. The length of exposed carbon fiber was 1 cm. Electron emission was measured. Typically, emission is initially very poor for such fibers. When the voltage is raised, many of these fibers fail catastrophically. Others survive this "high voltage treatment step" and begin to emit electrons. The carbon fiber used for Comparison Experiment C was such a fiber. The onset of emission is accompanied by modification of the surface, which results in "craters", "pits", or other jagged features. Presumably, emission comes from these irregular features. Emission from such fibers is spacially non-uniform, and it is not atypical for all of the emission to come from 1–4 sites on the surface. This is in contrast to the carbon fibers bombarded with an ion beam, where the number of emission sites is often too numerous to count and the sites often merge together into large areas of uniform emission. The emission current from the carbon fiber of Comparison Experiment C following the high voltage treatment step is also shown in FIG. 7.

Example 14

Carbon fibers (AS4, Hercules Inc., Wilminton, Del.) each of 7 $\mu$m diameter were spread in a holder in an array of 2–3 layers of fibers and were subjected to argon ion beam bombardment under the following conditions: ion beam essentially normal to the axis of the fibers, beam current of 20 mA, beam voltage of 1.2 kV, ion beam gun-sample distance of 4 inches (10 cm), beam diameter at sample of 2 inches (5 cm), and argon partial pressure of $1\times10^{-4}$ torr ($1.3\times10^{-2}$ Pa).

One side of the fibers was exposed to the ion beam bombardment for 30 minutes. Then the holder for the fibers was rotated 180° and the opposite sides of the fibers were exposed to the ion beam bombardment for 30 minutes under the same conditions. Following this double-sided ion beam bombardment scanning electron micrography showed that the carbon surface was comprised of carbon cones with carbon whiskers at the tips of the carbon cones. Electron emission was measured in Measurement Unit II and the length of exposed carbon fiber was 1 cm. The emission current was 10 $\mu$A at 500 V.

Example 15 and Comparison Experiment D

Diamond-like carbon (DLC) thin films about 1 $\mu$m thick for use in Example 15 and Comparison Experiment D were deposited by pulsed laser ablation onto square (25 mm×25 mm) silicon substrates 0.46 mm thick. The DLC film was deposited by ablating a graphite target using the $4^{th}$ harmonic line at 266 nm of a Spectra Physics GCR 170 pulsed Ng-YAG laser with 10 nanosecond pulses at 2 Hz repetition rate. The graphite target was prepared by slicing commercially available rods of 99.99% purity pyrolitic carbon (Ultra Carbon, a division of Carbone of America, Bay City, Mich.) 12 inches (30.5 cm) long and 1.5 inches (3.8 cm) in diameter. The graphite target was positioned at the center of the vacuum chamber about 4 cm from the silicon substrate. The laser fluence during deposition was 4 J/cm$^2$ and the pressure was maintained at $1\times10^{-6}$ torr ($1.3\times10^{-4}$ Pa). The 1 cm$^2$ gaussian laser beam was directed into the chamber by a pair of plane mirrors and focused onto a 2 mm×2 mm area on the surface of the solid graphite target by a 300 mm quartz lens positioned at the entrance of the vacuum chamber. Both the Si wafer and the graphite target were rotated during deposition. The target was held at a 10° angle off the normal to provide a larger area of very uniform coverage. Further uniformity was achieved by rastering the laser beam over an area 1 cm×1 cm square on the target using a set of motorized micrometers placed on the second plane mirror.

The DLC film for Comparison Experiment D was not ion beam bombarded while that for Example 15 was subjected to ion beam bombardment under the following conditions: ion beam makes a 45° angle of incidence with the film sample, beam current of 20 mA, beam voltage of 1.2 kV, ion beam gun-sample distance of 5 inches (12.5 cm), beam diameter at sample of 2 inches (5 cm), argon partial pressure of $1\times10^{-4}$ torr ($1.3\times10^{-2}$ Pa) and exposure time of 15 minutes.

Figure 8A:
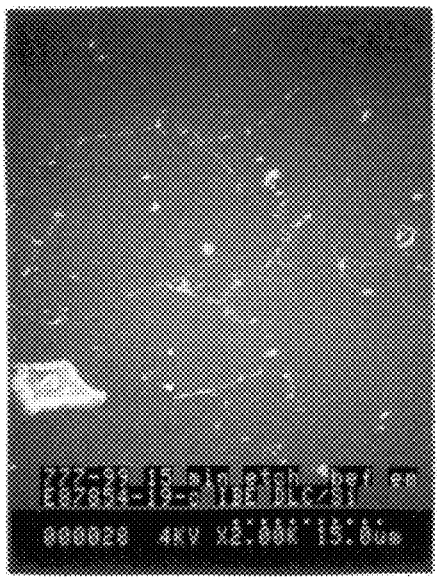
FIGS. 8(*a*) and 8(*b*) are scanning electron micrographs of carbon whiskers formed by ion beam bombardment of a diamond-like carbon thin film on a silicon substrate.
Figure 8B:
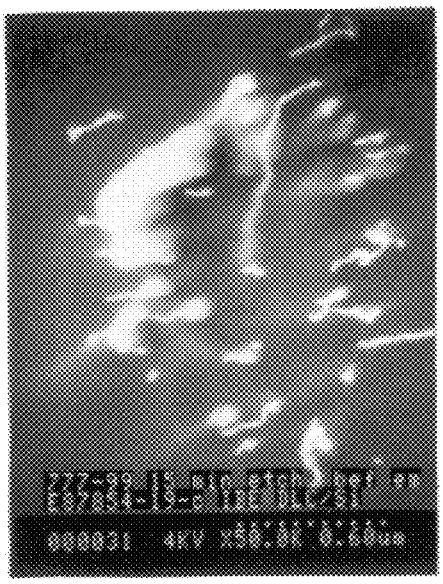

The results of ion beam etching thin DLC thin films are different than those obtained by etching thicker polycrystalline carbon thin films. Cone formation is more prevalent on the latter and whiskers only form after formation of the cones, i.e., after relatively long etching times. For DLC films, the whiskers form after an etching time of 15 minutes and are laced across the surface as shown in FIGS. 8(*a*) and 8(*b*).

Figure 9A:
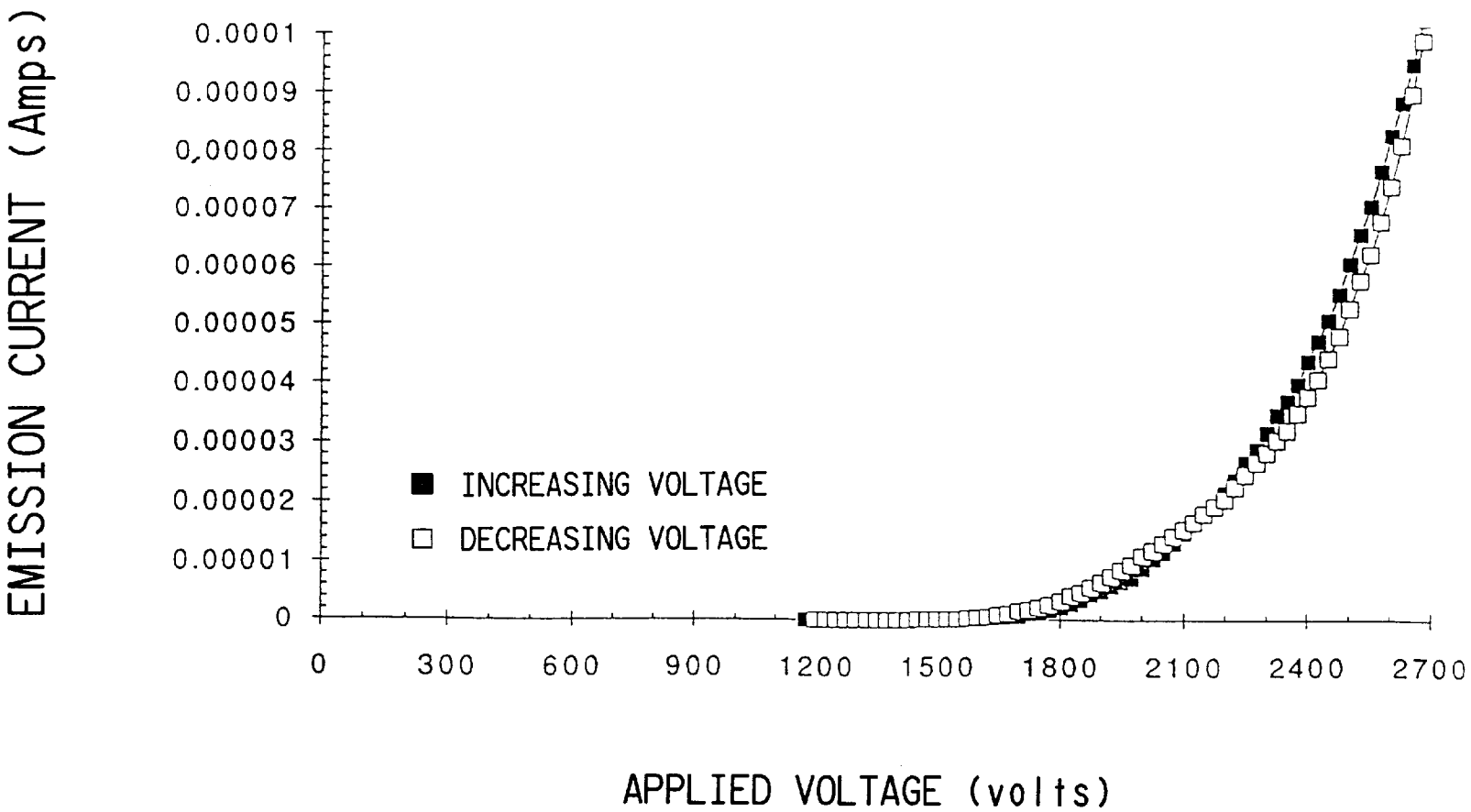
FIGS. 9(*a*) and 9(*b*) are plots of emission current as a function of applied voltage for an ion beam bombarded diamond-like carbon thin film on a silicon substrate.
Figure 9B:
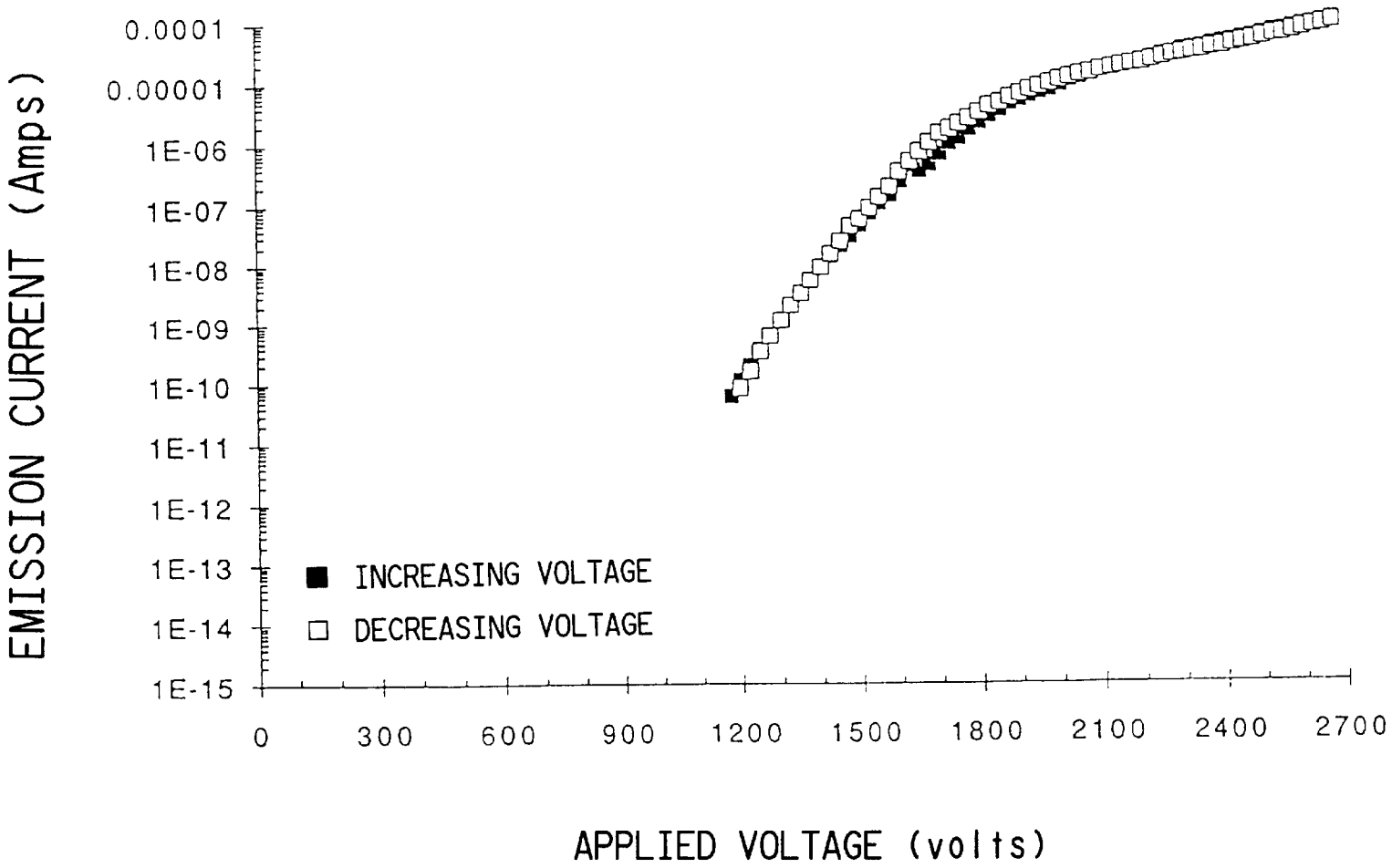

Emission measurements were carried out essentially as described in Example 1. Electron emission results from the DLC thin films of Example 15 and the Comparison Experiment D are shown in FIGS. 9(*a*) and 9(*b*). The area of the sample was 6.45 $cm^2$. The emission current was 40 $\mu$A at 2400 V.

The results of this Example show that carbon whiskers can be made to form by ion beam bombardment of non-graphitic carbons, e.g., DLC.

Example 16

A DLC thin film was deposited on a 125 $\mu$m diameter tungsten wire by pulse laser deposition using essentially the same process described in Example 15. The tungsten wire was cleaned in a 30% nitric acid solution for 20 minutes. The wire was then rinsed in abundant deoionized water followed by rinses in acetone and methanol baths. A 6 inch (2.5 cm) length of the tungsten wire was mounted on a rotary sample holder. A rack and pinion mechanism allowed the wire to be translated during the deposition of the DLC to attain a uniform coating along the length of the wire.

As in Example 15, the thin DLC film was deposited by ablating a graphite target using the $4^{th}$ harmonic line at 266 nm of a Spectra Physics GCR 170 pulsed Ng-YAG laser with 10 nanosecond pulses at 2 Hz repetition rate. The graphite target was prepared by slicing commercially available rods of 99.99% purity pyrolitic carbon (Ultra Carbon, Bay City, Mich.) 12 inches (30.5 cm) long and 1.5 inches (3.8 cm) in diameter. The graphite target was positioned at the center of the vacuum chamber about 4 cm from the tungsten wire. The laser fluence during deposition was 4 $J/cm^2$ and the pressure was maintained at $1\times10^{-6}$ torr ($1.3\times10^{-4}$ Pa). The 1 $cm^2$ gaussian laser beam was directed into the chamber by a pair of plane mirrors and focused onto a 2 mm×2 mm area on the surface of the solid graphite target by a 300 mm quartz lens positioned at the entrance of the vacuum chamber. The graphite target was rotated during the deposition. The target was held at a 10° angle off the normal to provide a larger area of very uniform coverage. Further uniformity was achieved by rastering the laser beam over an area 1 cm×1 cm square on the target using a set of motorized micrometers placed on the second plane mirror. In addition, the wire was translated at the rate of 1 mm/minute during the deposition. A DLC film with thickness of about 1 $\mu$m was deposited.

Figure 10A:
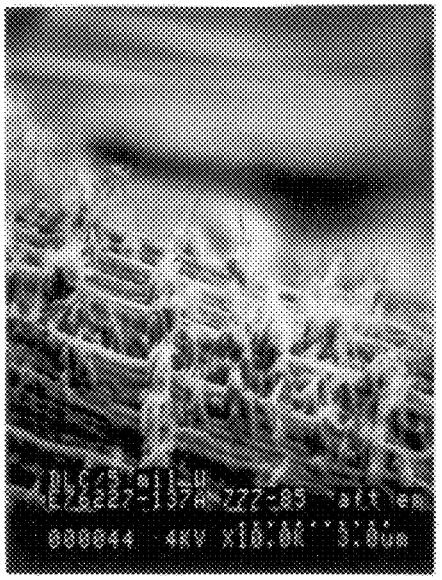
FIGS. 10(*a*) and 10(*b*) are scanning electron micrographs of carbon whiskers formed by ion beam bombardment of a diamond-like carbon thin film on a metal wire.
Figure 10B:
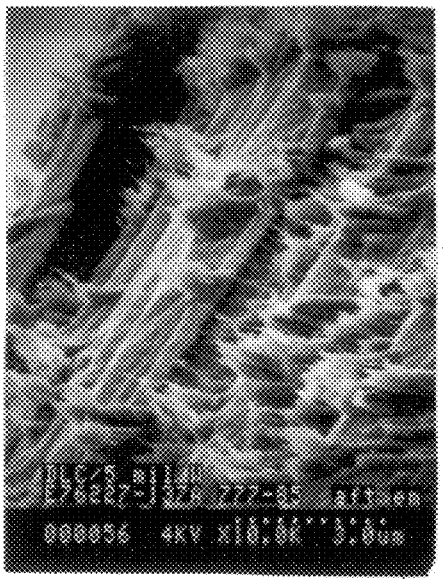
Figure 11:
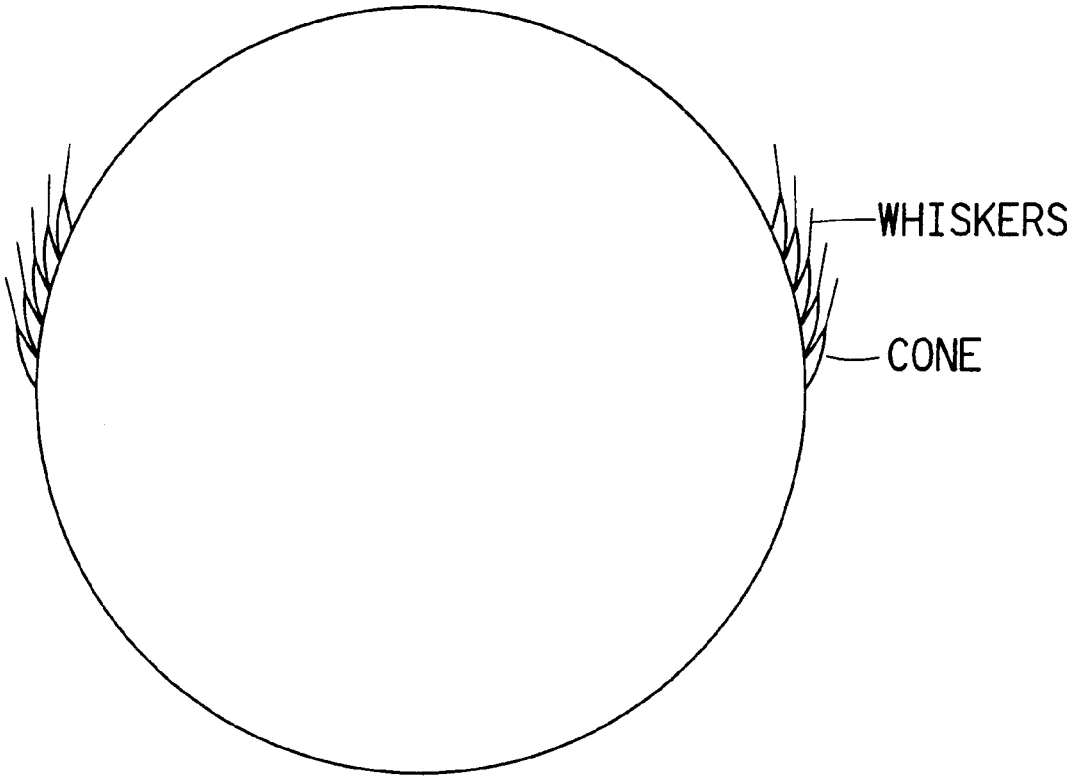
FIG. 11 is a schematic diagram showing the location of carbon whiskers and carbon cones formed by ion beam bombardment of a diamond-like carbon thin film on a tungsten wire.

The DLC film on the tungsten wire was subjected to argon ion beam bombardment under the following conditions: ion beam essentially normal to the axis of the wire, beam current of 18 mA, beam voltage of 1.2 kV, ion beam gun-sample distance of 4 inches (10 cm), beam diameter at sample of 2 inches (5 cm) andargon partial pressure of $10^{-4}$ torr ($1.3\times10^{-2}$ Pa). One side of the coated wire was exposed to the ion beam bombardment for 40 minutes. Following this ion beam bombardment the surface contained cones and whiskers as shown in FIGS. 10(*a*) and 10(*b*). The location of these cones and whiskers was limited to the parts of the tungsten wire shown in the schematic diagram of FIG. 11.

Figure 12:
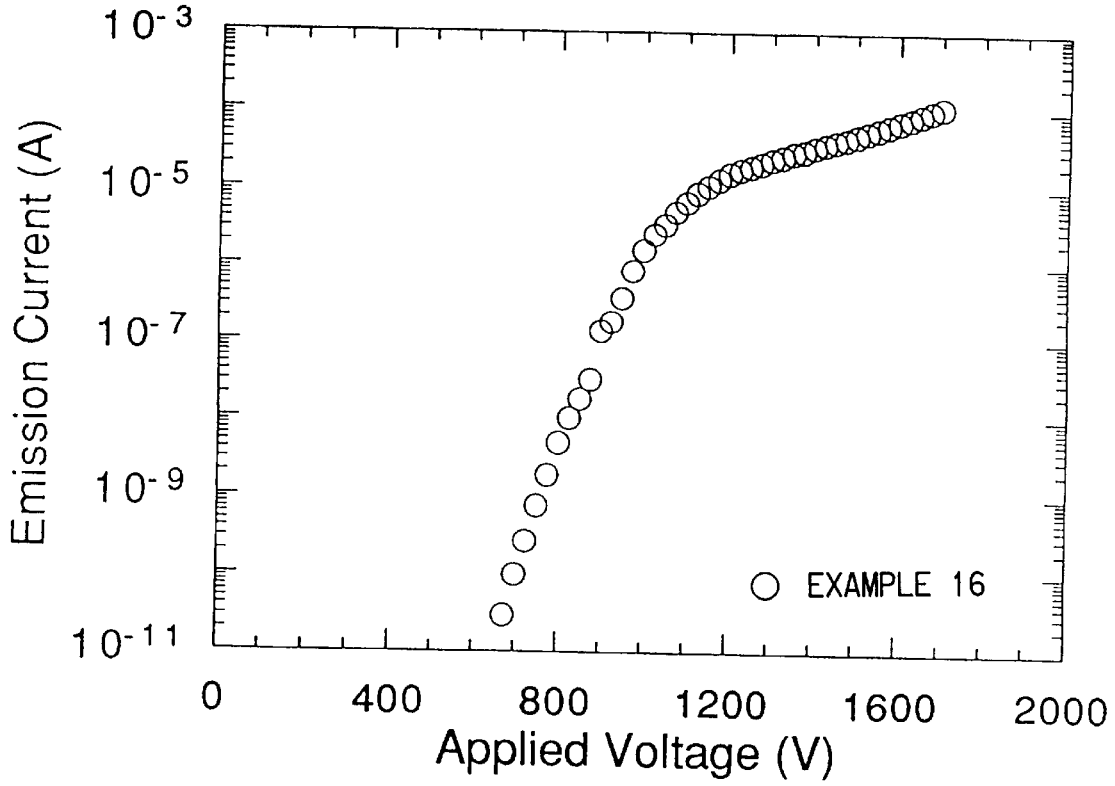
FIG. 12 is a plot of emission current as a function of applied voltage for an ion beam bombarded diamond-like carbon thin film on a tungsten wire having a diameter of 125 $\mu$m (Example 16).

Electron emission was measured in Measurement Unit II and the length of exposed DLC-coated wire was 1 cm. The emission current as a function of voltage is shown in FIG. 12.

The results of this experiment indicate that metal wires can be coated with non-graphitic carbon and that the emission of this carbon can be greatly improved by ion beam bombardment.

Examples 17–20 and Comparison Experiment E

These Examples show the process for producing a 1 $\mu$m DLC film on a conducting core, i.e., a wire, by ultraviolet laser ablation with a graphite target. The wires on which the DLC was to be deposited were mounted onto a rectangular plate that connected to a rack and pinion mechanism which allowed their translation during deposition thereby assuring a uniform coating on the fiber. Prior to deposition the wires, mounted on an aluminum frame, were cleaned in a 30% nitric acid solution for 20 minutes. This bath was followed by a rinse in abundant deionized water with subsequent rinses in acetone and methanol baths. The conducting fibers were placed in a vacuum chamber where a DLC film covering was applied by ablating a graphite target.

The graphite target was made by slicing commercial available rods (Ultra Carbon, Bay City, Mich., pyrolitic graphite, 12" length×1.5" in diameter rods at 99.99% purity). The target was positioned at the center of the vacuum chamber about 4 cm away from the wires. The thin DLC film was deposited by ablating the graphite target using the $4^{th}$ harmonic line at 266 nm of a Spectra Physics GCR 170 pulsed Ng-YAG with 10 nanosecond pulses at 2 Hz repetition rate. The laser fluence during deposition was 4 $J/cm^2$ and the background pressure was maintained at $1\times10^{-6}$ torr ($1.3\times10^{-4}$ Pa). The 1 $cm^2$ gaussian beam is directed into the chamber by a pair of plane mirrors and focused by a 300 mm quartz lens positioned at the entrance of the vacuum chamber onto a 2.0 mm by 2.0 mm spot on the surface of the solid graphite pellet target. Since the target was held at a 10° angle off the normal the ablation plume, its rotation resulted in a 2" square area of very uniform coverage. Further uniformity was achieved by rastering the laser beam onto a 1×1 cm square on the target with a set of motorized micrometers placed on the last plane mirror.

The DLC films of Example 17 and Comparison Experiment E were deposited onto 4 mil (0.1 mm) diameter tungsten wire in a sequence in which the target was ablated for 20 minutes and then the wire holder was translated for 45 seconds at a rate of 1 mm/second and the ablation and translation steps repeated. The total ablation time to deposit a DLC film about 1 $\mu$m thick uniformly over the length of the wire was 140 minutes. In Example 18, the DLC film was deposited onto 2 mil (0.05 mm) diameter Ni wire. In Example 19 the DLC film was deposited onto 4 mil (0.1 mm) diameter wire, 99.4% tungsten and 0.6% thorium. In Example 20, the DLC film was deposited onto 2 mil (0.05 mm) diameter aluminum wire.

The DLC-coated wires of Examples 17–20 were subjected to argon ion beam bombardment under the following conditions: ion beam makes a 45° angle of incidence with the film sample beam current of 20 mA, beam voltage of 1.2 kV, ion beam gun-sample distance of 5 inches (12.5 cm), beam diameter at sample of 2 inches (5 cm) and argon partial pressure of $1\times10^{-4}$ torr ($1.3\times10^{-2}$ Pa). The exposure time to the ion beam bombardment for Examples 17–20 was 30, 15, 20 and 30 minutes, respectively.

Figure 13:
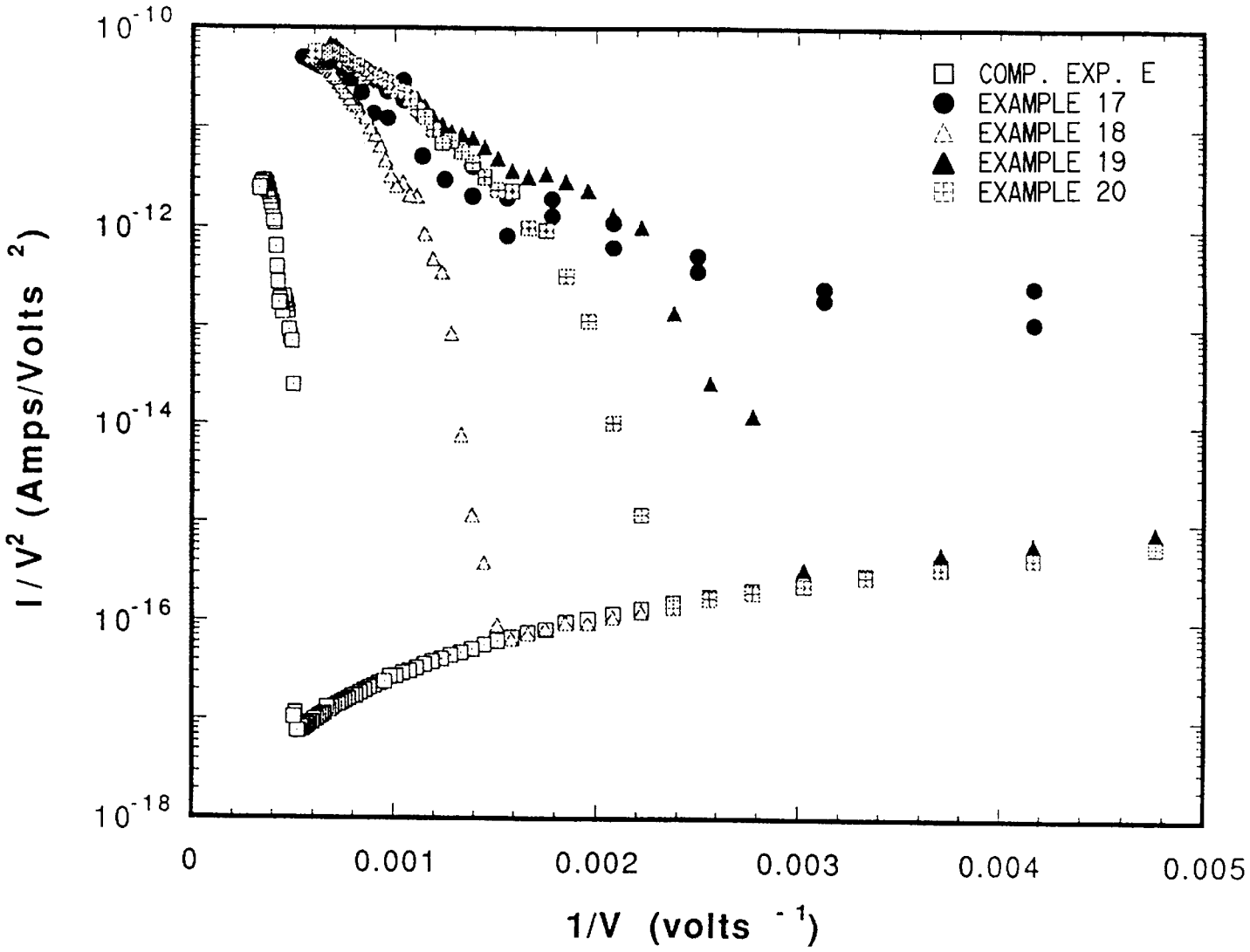
FIG. 13 is a plot of $I/V^2$ as a function of 1/V for a diamond-like carbon thin film on tungsten wire before ion beam bombardment (Comparative Experiment E) and following ion beam bombardment (Example 17) and on various other metal wires following ion beam bombardment. The other ion beam treated wire samples include nickel (Example 18), nickel/thorium (Example 19), and aluminum (Example 20).

Electron emission was measured in Measurement Unit II and the length of exposed DCL-coated wire was 1 cm. The emission results for Examples 17–20 and Comparison Experiment E are shown in FIG. 13. The improvement in emission properties as a result of ion beam bombardment is apparent by comparing the results for Example 17 and Comparison Experiment E.

Examples 21–22 and Comparison Experiments F–G

These Examples show the process for producing a DLC thin film on a conducting core, e.g., a metal wire, by ultraviolet laser ablation with ablation targets comprising a polymer and a metal in addition to graphite powder and the improvement in emission properties resulting from ion beam bombardment of these DLC thin films.

The 4 mil (0.1 mm) diameter tungsten wires on which the DLC was to be deposited were mounted onto a rectangular plate that connected to a rack and pinion mechanism allowed their translation during deposition thereby assuring a uniform coating throughout the fiber. Prior to deposition the wires, mounted on an aluminum frame, were cleaned in a 30% nitric acid solution for 20 minutes. This bath was followed by a rinse in abundant deionized water with subsequent rinses in acetone and methanol baths. The conducting fibers were placed in a vacuum chamber. The ablation target used in Example 21 and Comparison Example F comprises 10% Pb (200 mesh, 99.999% purity Aesar, Ward Hill, Mass.), 10% polyethylene (Scientific Polymer Products, Ontario, N.Y.) and 80% graphite (briquetting grade, 100 mesh, 99.995% purity, Aesar, Ward Hill, Mass.). The powders, 0.3 g of polyethylene, 0.3 g of Pb and 2.4 g of graphite, were mixed in a mortar and pressed to 10,000 PSI into a 1.25" (3.2 cm) diameter stainless steel die at ambient temperature. The target above was then placed in the center of the vacuum chamber and ablated onto a 6 inch length of 2 mil tungsten wire. The laser fluence was 3 J/cm$^2$ and the total deposition time was 180 minutes. The ablation procedure used in Example 22 and Comparison Example G was identical to that used in Example 21 and Comparison Example F except the ablating target used in Example 22 and Comparison Example G contained 10% $Mo_2C$ (Goodfellow Cambridge Ltd., Cambridge, England) powder instead of Pb. In each instance the thickness of the DLC fm was about 1 $\mu$m.

The DLC-coated wires of Examples 21 and 22 were subjected to argon ion beam bombardment under the following conditions: ion beam makes a 45° angle of incidence with the film sample beam current of 20 mA, beam voltage of 1.2 kV, ion beam gun-sample distance of 5 inches (12.5 cm), beam diameter at sample of 2 inches (5 cm), argon partial pressure of $1\times10^{-4}$ torr ($1.3\times10^{-2}$ Pa) and exposure time of 30 minutes.

Figure 14:
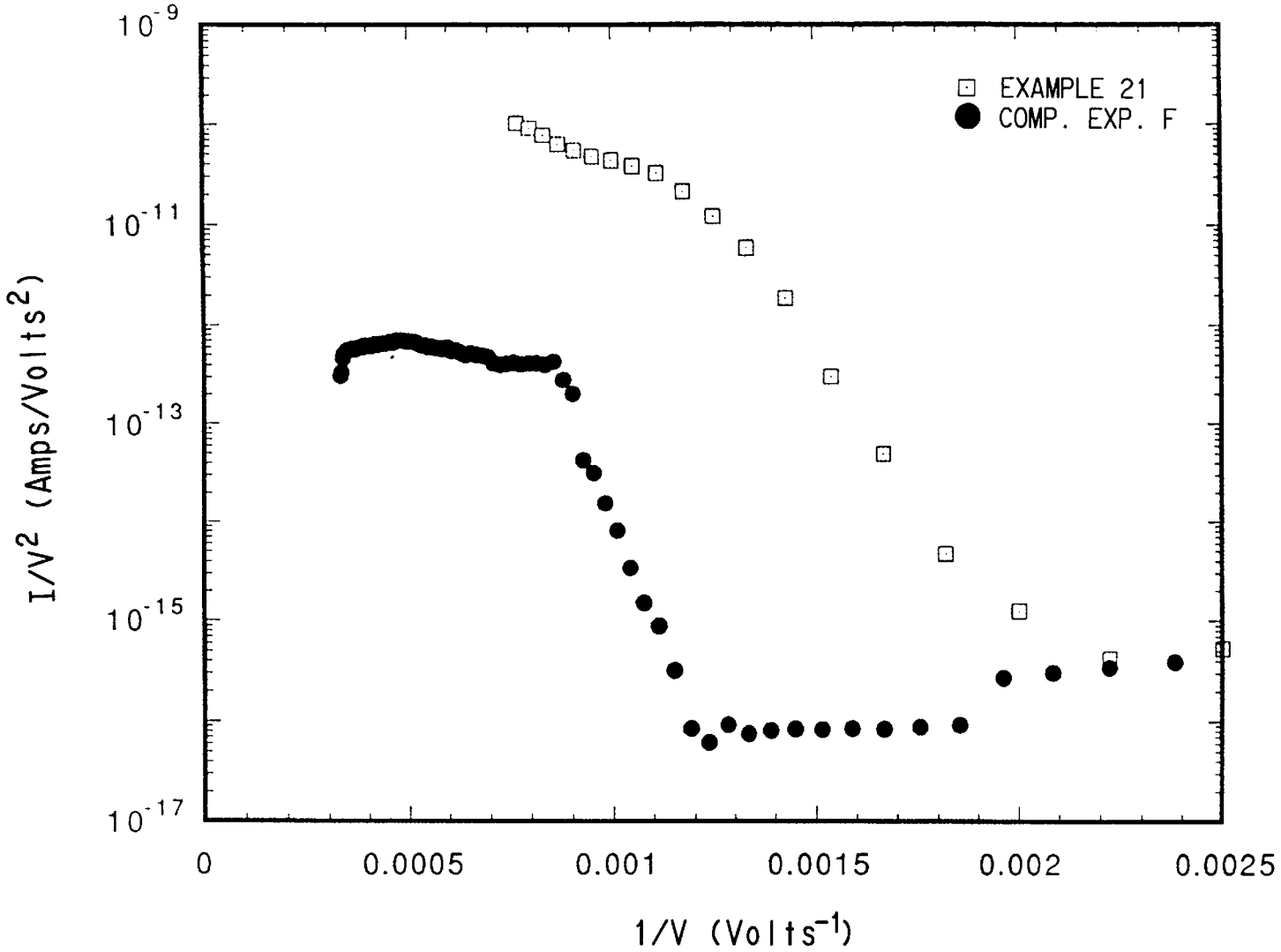
FIG. 14 is a plot of $I/V^2$ as a function of 1/V for a Pb-containing diamond-like carbon thin film on a tungsten wire before ion beam bombardment (Comparative Experiment F) and after ion beam bombardment (Example 21).
Figure 15:
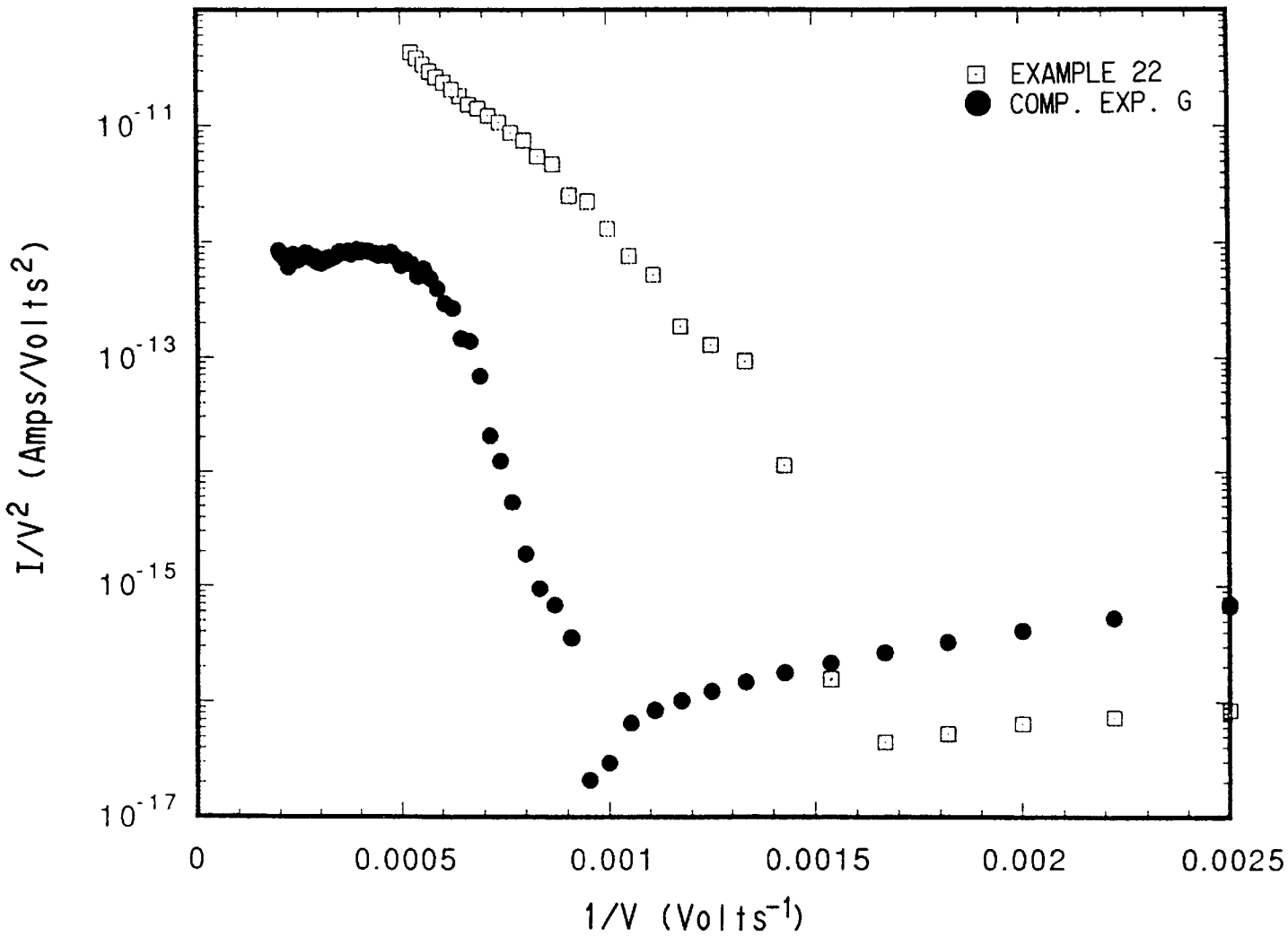
FIG. 15 is a plot of $I/V^2$ as a function of 1/V for a Mo-containing diamond-like carbon thin film on a tungsten wire before ion beam bombardment (Comparative Experiment G) and after ion beam bombardment (Example 22).

Electron emission was measured in Measurement Unit II and the length of exposed DCL-coated wire was 1 cm. The emission results for Example 21 and Comparison Experiment F are shown in FIG. 14. The emission data for Comparison Example F shows the emission from the "as deposited" Pb-containing DLC-coated tungsten wire prior to ion beam bombardment. The emission data for Example 21 shows the emission data from the Pb-containing DLC-coated tungsten wire after ion beam bombardment. The emission results for Example 22 and Comparison Experiment G are shown in FIG. 15. The emission data for Comparison Example G shows the emission from the "as deposited" Mo-containing DLC-coated tungsten wire prior to ion beam bombardment. The emission data for Example 22 shows the emission data from the Mo-containing DLC-coated tungsten wire after ion beam bombardment. The improvement in emission properties after ion beam bombardment is apparent in both Examples 21 and 22.

Examples 23–24 and Comparison Experiment H

These Examples show the process for producing a carbon coating on a conducting core by coating a metal wire with a polyacrylonitrile solution and the improvement in emission properties resulting from ion beam bombardment of these carbon coatings.

Prior to the application of the carbon coating, the 4 mil (0.1 mm) diameter tungsten wires were cleaned in 30% nitric acid solution for 30 minutes followed by abundant de-ionized water, acetone and methanol rinses. The carbon layer was coated onto the wire from solution. The solution was prepared by mixing 8 g of polyacrylonitrile (PAN) (Aldrich, Milwakee, Wis.) into 100 g of methyl sulfoxide at 80° C. The heated solution was stirred until the polymer was fully dissolved and then cooled to ambient temperature. The viscous PAN solution was then applied to the clean tungsten wires with a small brush. The wire coated with the PAN layer was stabilized by heating in an oven at 250° C. for 30 minutes. This coating and stabilizing was carried out three times and the coated wires then underwent a final heating in argon at 1000° C. for 30 minutes. In Example 23, 100 nm of Ag were sputtered onto the clean tunsten wire prior to the application of the PAN coatings.

Following the firing procedure for the PAN fibers described above, the samples of Examples 23 and 24 were subjected to argon ion beam bombardment under the following conditions: ion beam makes a 45° angle of incidence with the film sample beam current of 18 mA, beam voltage of 1.6 kV, ion beam gun-sample distance of 5 inches (12.5 cm), beam diameter at sample of 2 inches (5 cm), argon partial pressure of $1\times10^{-4}$ torr ($1.3\times10^{-2}$ Pa) and exposure time of 30 minutes. In Comparative Example H, the sample was not bombarded with an ion beam after firing.

Figure 16:
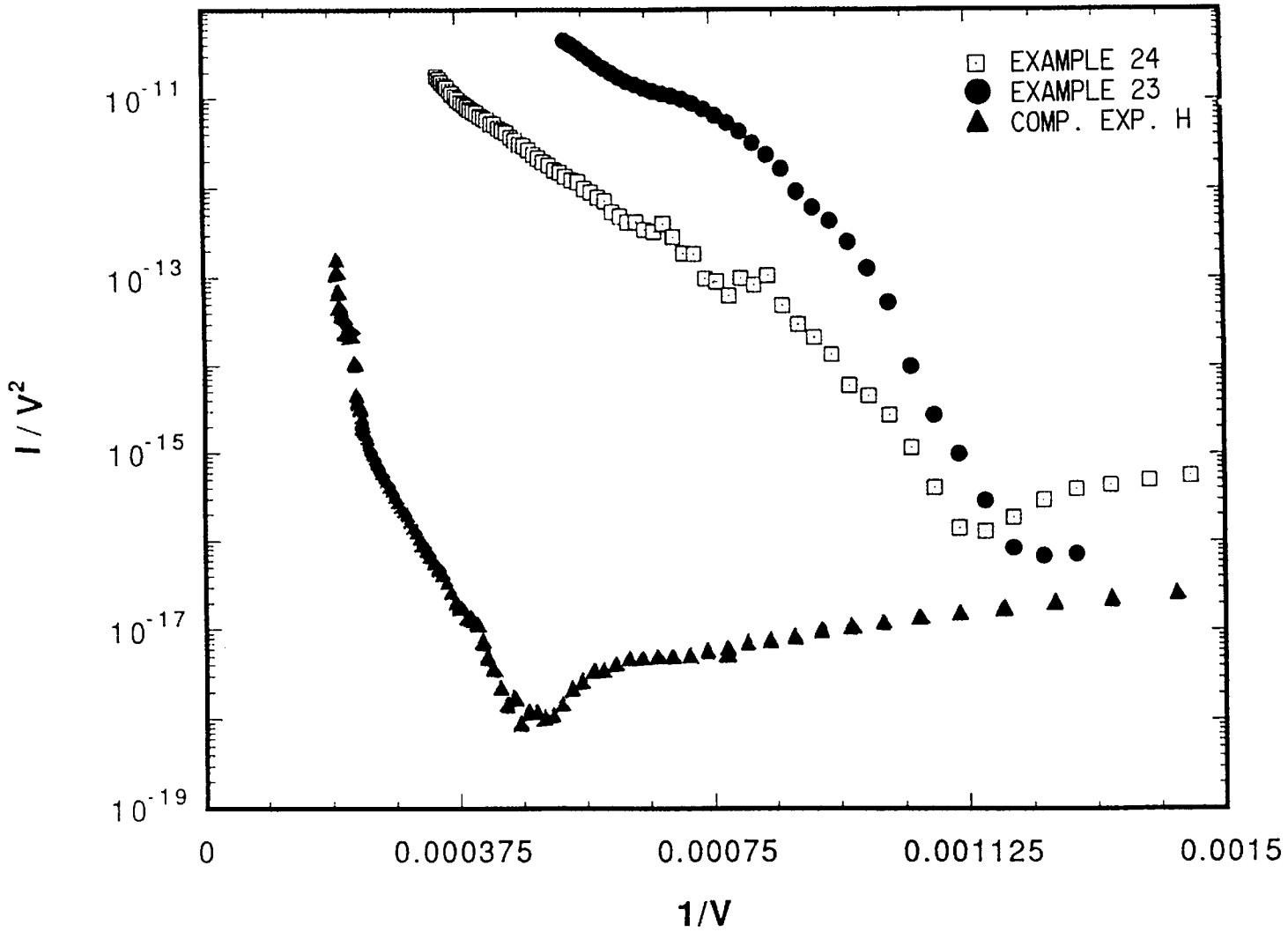
FIG. 16 is a plot of $I/V^2$ as a function of 1/V for a diamond-like carbon thin film on a tungsten wire before ion beam bombardment (Comparative Experiment H) and for two samples after ion beam bombardment (Examples 23 and 24).

Electron emission was measured in Measurement Unit II and the length of exposed PAN-coated wire was 1 cm. The emission results for Examples 23 and 24 and Comparison Experiment H are shown in FIG. 16 and again demonstrate the improved emission properties resulting from ion beam bombardment.

Example 25

A boron-doped diamond-like carbon (DLC) thin film about 1 $\mu$m thick was deposited by pulsed laser ablation onto a 2 inch (5.1 cm) diameter silicon (100) wafer substrate and then bombarded with an ion beam to produce an electron emitter with very good emission properties.

Prior to the deposition of the boron-doped DLC film, the silicon substrate was cleaned in a 15% HF solution and then rinsed in deionized water. The silicon substrate was then masked with a 2 inch (5.1 cm) diameter piece of 4 mil (0.1 mm) thick Kapton® polyimide film (DuPont, Wilmington, Del.) with a 2 cm×2 cm square cut out of the center of the masked to expose the silicon. The mask was held on the silicon by four 2 mm×2 mm pieces of double stick tape placed 90° apart and 2 mm from the edge of the substrate.

The boron-doped DLC film was deposited by ablating a target using the $4^{th}$ harmonic line at 26 nm of a Spectra Physics GCR 170 pulsed Ng-YAG laser with 10 nanosecond pulses at 6 Hz repetition rate. The ablation target comprises 9% boron carbide powder (Goodfellow Cambridge, Ltd., Cambridge, England) and 92% graphite powder (briquetting grade, 100 mesh, 99.995% purity, Aesar, Ward Hill, Mass.). The powder, 0.4 g of boron carbide and 4.0 g of graphite, were mixed in a mortar for about 10 minutes and pressed to 10,000 psi ($6.9\times10^7$ Pa) in a 1" (2.5 cm) diameter stainless steel die at ambient temperature. The pressure was maintained for 5 minutes. The target was then placed at the center of the vacuum chamber on a sample holder about 4 cm from the silicon substrate. The laser fluence during deposition was 5 J/cm$^2$ and the pressure was maintained at $1\times10^{-6}$ torr ($1.3\times10^{-4}$ Pa). The 1 cm$^2$ gaussian laser beam was directed into the chamber by a pair of plane mirrors and focused onto a 2.5 mm×2 mm area on the surface of the solid graphite target by a 300 mm quartz lens positioned at the entrance of the vacuum chamber. The silicon surface was parallel to the surface of the target holder. Both the silicon substrate and the graphite target were rotated during deposition. The target was held at a 15° angle off the normal to provide a larger area of very uniform coverage. Further uniformity was achieved by rastering the laser beam over an area 1 cm×1 cm square on the target using a set of motorized micrometers placed on the second plane mirror.

The boron-doped DLC film was subjected to ion beam bombardment under the following conditions: ion beam makes a 45° angle of incidence with the film sample, beam current of 18 mA, beam voltage of 1.2 kV, ion beam gun-sample distance of 5 inches (12.5 cm), beam diameter at sample of 2 inches (5 cm), argon partial pressure of $1\times10^{-4}$ torr ($1.3\times10^{-2}$ Pa) and exposure time of 30 minutes.

Figure 17:
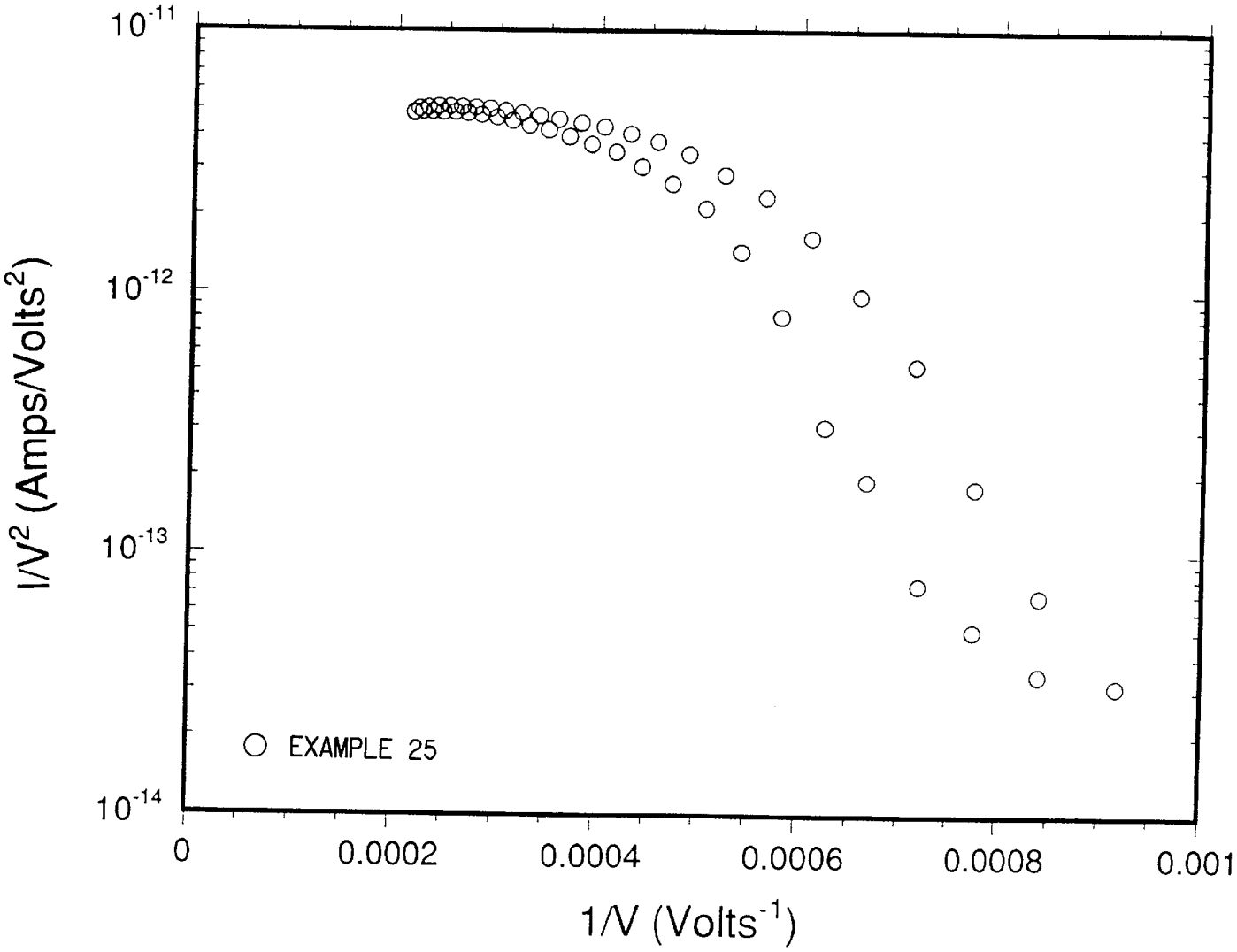
FIG. 17 is a plot of $I/V^2$ as a function of 1/V for an ion beam bombarded boron-containing diamond-like-carbon thin film on a silicon substrate (Example 25). The plot shows a hysteresis between increasing voltage and decreasing voltage.

Emission measurements were carried out essentially as described in Example 1. Electron emission results from the boron-doped DLC thin film are shown in FIG. 17.

Although particular embodiments of the present invention have been described in the foregoing description, it will be understood by those sklled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A field emission electron emitter comprising solid carbon whiskers which have diameters from about 0.5 nm to about 50 nm and lengths of at least 2 microns.

2. A field emission electron emitter comprising carbon cones which have diameters from about 0.1 microns to about 0.5 microns and heights from about 0.3 microns to about 0.8 microns.

3. A field emission cathode comprised of solid carbon whiskers attached to a substrate, wherein the solid carbon whiskers have diameters from about 0.5 nm to about 50 nm and lengths of at least 2 microns.

4. A field emission cathode comprised of carbon cones attached to a substrate, wherein the carbon cones have diameters from about 0.1 microns to about 0.5 microns and heights from about 0.3 microns to about 0.8 microns.

5. The field emission cathode of claims 3 or 4 wherein the substrate is an electrical conductor.

6. The field emission cathode of claims 3 or 4 wherein the substrate is a wire.

7. The field emission cathode of claims 3 or 4 wherein the substrate is a silicon wafer.

* * * * *